US011678119B2

(12) United States Patent
Yamada et al.

(10) Patent No.: US 11,678,119 B2
(45) Date of Patent: Jun. 13, 2023

(54) VIRTUAL SOUND IMAGE CONTROL SYSTEM, CEILING MEMBER, AND TABLE

(71) Applicant: Panasonic Intellectual Property Management Co., Ltd., Osaka (JP)

(72) Inventors: Wakio Yamada, Hyogo (JP); Daichi Toh, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/546,407

(22) Filed: Dec. 9, 2021

(65) Prior Publication Data

US 2022/0103947 A1 Mar. 31, 2022

Related U.S. Application Data

(62) Division of application No. 16/642,830, filed as application No. PCT/JP2018/030720 on Aug. 21, 2018, now Pat. No. 11,228,839.

(30) Foreign Application Priority Data

Aug. 29, 2017 (JP) ..... JP2017-164774

(51) Int. Cl.
*H04R 5/02* (2006.01)
*F21S 8/06* (2006.01)
(Continued)

(52) U.S. Cl.
CPC ..... *H04R 5/02* (2013.01); *F21S 8/06* (2013.01); *F21V 33/0056* (2013.01); *H04R 1/025* (2013.01); *H04S 1/00* (2013.01)

(58) Field of Classification Search
CPC ... H04R 5/02; H04R 1/025; H04S 1/00; F21S 8/06; F21V 33/0056
See application file for complete search history.

(56) References Cited

U.S. PATENT DOCUMENTS

2008/0253591 A1 10/2008 Schobben et al.
2009/0180633 A1 7/2009 Ishibashi et al.
(Continued)

FOREIGN PATENT DOCUMENTS

JP 2001-177609 A 6/2001
JP 2007-014750 A 1/2007
(Continued)

OTHER PUBLICATIONS

International Search Report and Written Opinion issued in International Patent Application No. PCT/JP2018/030720, dated Oct. 9, 2018; with partial English translation.
(Continued)

*Primary Examiner* — Andrew L Sniezek
(74) *Attorney, Agent, or Firm* — McDermott Will & Emery LLP

(57) ABSTRACT

In a virtual sound image control system according to the present invention, a signal processor generates the acoustic signal and outputs the acoustic signal to the two-channel loudspeakers so as to create a virtual sound image to be perceived by a user as a stereophonic sound image. The two-channel loudspeakers are arranged such that a first listening area and a second listening area for the user are symmetric to each other with respect to a virtual plane including a virtual line segment connecting the two-channel loudspeakers together.

17 Claims, 16 Drawing Sheets

(51) Int. Cl.

| | |
|---|---|
| ***F21V 33/00*** | (2006.01) |
| ***H04R 1/02*** | (2006.01) |
| ***H04S 1/00*** | (2006.01) |

(56) References Cited

U.S. PATENT DOCUMENTS

| | | | | |
|---|---|---|---|---|
| 2009/0316939 | A1* | 12/2009 | Matsumoto | H04S 7/30 381/302 |
| 2013/0003998 | A1 | 1/2013 | Kirkeby et al. | |
| 2016/0295317 | A1 | 10/2016 | Van Der Linden | |

FOREIGN PATENT DOCUMENTS

| | | | |
|---|---|---|---|
| JP | 2007-520122 | A | 7/2007 |
| JP | 2007-318550 | A | 12/2007 |
| JP | 2008-177887 | A | 7/2008 |
| JP | 2008-271427 | A | 11/2008 |
| JP | 2010-171513 | A | 8/2010 |
| JP | 2012-054669 | A | 3/2012 |
| JP | 2012-231448 | A | 11/2012 |
| JP | 2013-062772 | A | 4/2013 |
| JP | 2015-144395 | A | 8/2015 |
| WO | 2005/072011 | A1 | 8/2005 |

OTHER PUBLICATIONS

Notice of Reasons for Refusal issued in Japanese Patent Application No. 2019-539378, dated Feb. 2, 2021; with English translation.

Japanese Office Action dated Sep. 14, 2021 in corresponding Japanese Patent Application No. 2019-539378; with English translation.

Non-Final Office Action issued in U.S. Appl. No. 16/642,830, dated Apr. 5, 2021.

Notice of Allowance issued in U.S. Appl. No. 16/642,830, dated Sep. 10, 2021.

* cited by examiner

VIRTUAL SOUND IMAGE CONTROL SYSTEM, CEILING MEMBER, AND TABLE

CROSS-REFERENCE OF RELATED APPLICATIONS

This application is a Divisional application of U.S. patent application Ser. No. 16/642,830, filed on Feb. 27, 2020, which is the U.S. National Phase under 35 U.S.C. § 371 of International Patent Application No. PCT/JP2018/030720, filed on Aug. 21, 2018, which in turn claims the benefit of Japanese Application No. 2017-164774, filed on Aug. 29, 2017, the entire disclosures of which applications are incorporated by reference herein.

TECHNICAL FIELD

The present disclosure relates to a virtual sound image control system, a light fixture, a kitchen system, a ceiling member, and a table.

BACKGROUND ART

An audio reproduction system has been known which emits a sound from a loudspeaker to localize a virtual sound image at an arbitrary location. Patent Literature 1, for example, discloses that providing two or more pairs of loudspeakers also achieves the effect of localizing a virtual sound image even when a plurality of users are present side by side in front of the loudspeakers.

Nevertheless, the system of Patent Literature 1 requires two or more pairs of loudspeakers to create sound images to be perceived by the plurality of users as stereophonic sound images, and therefore, comes to have a complex system configuration.

CITATION LIST

Patent Literature

Patent Literature 1: JP 2012-54669 A

SUMMARY OF INVENTION

It is therefore an object of the present disclosure to provide a virtual sound image control system, a light fixture, a kitchen system, a ceiling member, and a table, all of which are configured to create, using a simple configuration with two-channel loudspeakers, sound images to be perceived by a plurality of users as stereophonic sound images.

A virtual sound image control system according to an aspect of the present disclosure includes two-channel loudspeakers and a signal processor. The two-channel loudspeakers each receive an acoustic signal and emit a sound. The signal processor generates the acoustic signal and outputs the acoustic signal to the two-channel loudspeakers so as to create a virtual sound image to be perceived by a user as a stereophonic sound image. The two-channel loudspeakers have the same emission direction. The two-channel loudspeakers are arranged in line in the emission direction.

A virtual sound image control system according to another aspect of the present disclosure includes two-channel loudspeakers and a signal processor. The two-channel loudspeakers each receive an acoustic signal and emit a sound. The signal processor generates the acoustic signal and outputs the acoustic signal to the two-channel loudspeakers so as to create a virtual sound image to be perceived by a user as a stereophonic sound image. The two-channel loudspeakers are arranged such that a first listening area and a second listening area for the user are symmetric to each other with respect to a virtual plane including a virtual line segment connecting the two-channel loudspeakers together.

A light fixture according to still another aspect of the present disclosure includes: the two-channel loudspeakers that form parts of the virtual sound image control system described above; a light source; and a light fixture body equipped with the two-channel loudspeakers and the light source.

A kitchen system according to yet another aspect of the present disclosure includes: the two-channel loudspeakers that form parts of the virtual sound image control system described above; and a kitchen counter equipped with the two-channel loudspeakers.

A ceiling member according to yet another aspect of the present disclosure includes: the two-channel loudspeakers that form parts of the virtual sound image control system described above; and a panel equipped with the two-channel loudspeakers.

A table according to yet another aspect of the present disclosure includes: the two-channel loudspeakers that form parts of the virtual sound image control system described above; and a tabletop equipped with the two-channel loudspeakers.

DESCRIPTION OF EMBODIMENTS

An exemplary embodiment to be described below relates to a virtual sound image control system, a light fixture, a kitchen system, a ceiling member, and a table, and more particularly relates to a virtual sound image control system, a light fixture, a kitchen system, a ceiling member, and a table, all of which are equipped with two-channel loudspeakers.

First Embodiment

Figure 1:
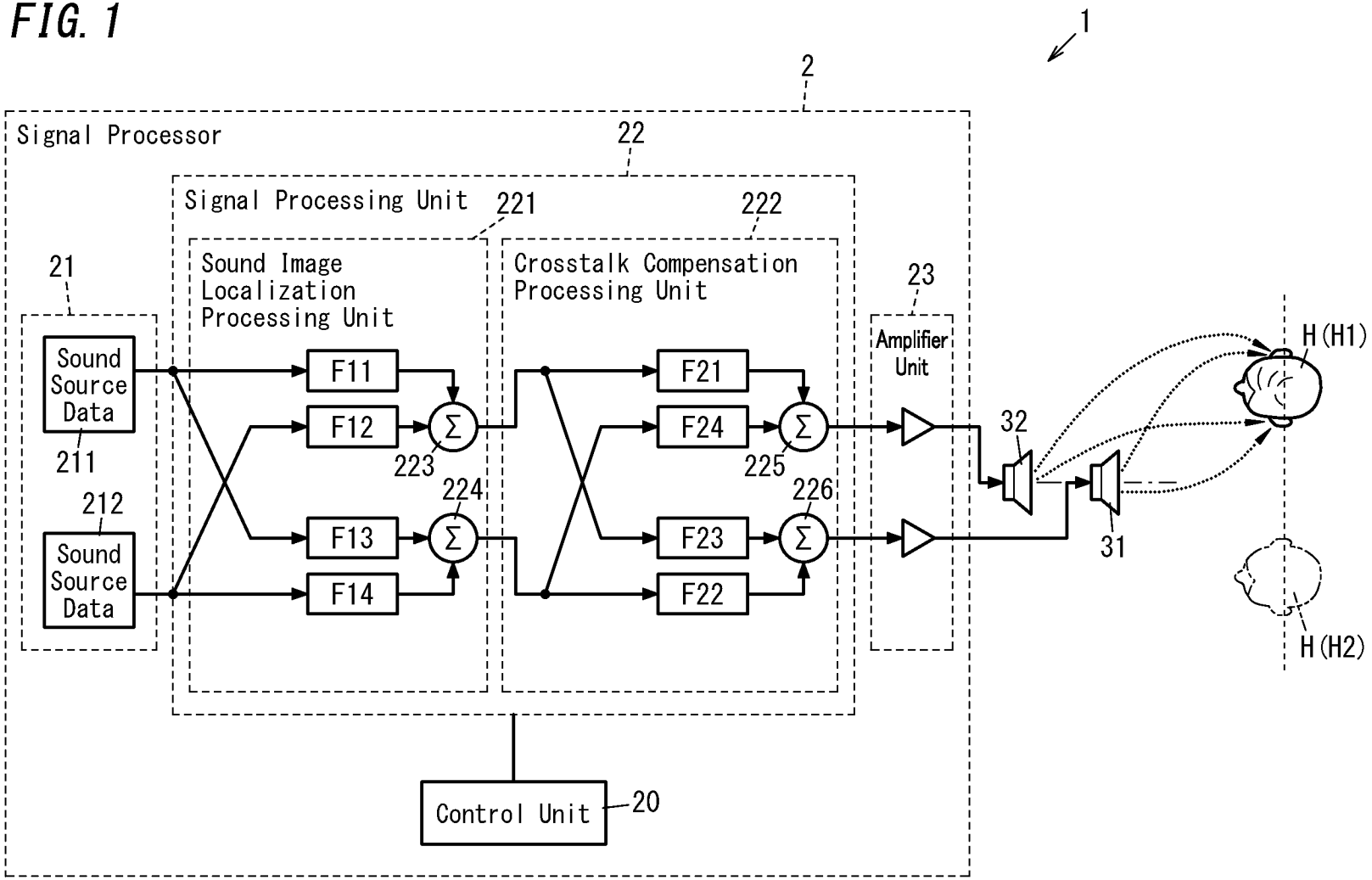
FIG. 1 is a block diagram illustrating a configuration for a virtual sound image control system according to a first exemplary embodiment.

FIG. 1 illustrates a configuration for a virtual sound image control system 1 according to a first exemplary embodiment. The virtual sound image control system 1 is implemented as a transaural system including a signal processor 2 and two-channel loudspeakers 31 and 32. The two-channel loudspeakers 31 and 32 each receive as associated one of two-channel acoustic signals generated by the signal processor 2 and emit a sound by reproducing the acoustic signal. This virtual sound image control system 1 creates sound images to be perceived, by a plurality of users H who are present around the two-channel loudspeakers 31 and 32, as stereophonic sound images.

The signal processor 2 includes a control unit 20, a sound source data storage unit 21, a signal processing unit 22, and an amplifier unit 23.

The signal processor 2 will be described in detail. Note that in this embodiment, the signals are supposed to be processed digitally from the sound source data storage unit 21 through the signal processing unit 22, and the respective acoustic signals output from the signal processing unit 22 are supposed to be analog signals. However, this is only an example and should not be construed as limiting. Alternatively, a configuration in which the loudspeakers 31 and 32 perform digital-to-analog conversion may also be adopted.

The sound source data storage unit 21 includes a storage device (which is suitably a semiconductor memory but may also be a hard disk drive) for storing at least one type (suitably multiple types) of sound source data. The signal processing unit 22 has the capability of controlling the location of a virtual sound image (hereinafter simply referred to as a "sound image" unless there is any special need) (i.e., the capability of localizing the sound image). The control unit 20 has the capability of selecting sound source data from the sound source data storage unit 21. Note that the sound source data storage unit 21 shown in FIG. 1 stores two types of sound source data 211 and 212.

As used herein, sound source data refers to data of a sound that has been converted into a digitally processible format. Examples of the sound source data include data of a variety of sounds such as environmental sounds, musical sounds, and audio accompanying video. The environmental sounds are collected from a natural environment. Examples of the environmental sounds include the murmur of rivers, bird songs, the sounds of insects, wind sounds, waterfall sounds, rain sounds, wave sounds, and sounds with 1/f fluctuation.

The signal processing unit 22 includes a signal processing processor (such as a digital signal processor (DSP)). The signal processing unit 22 functions as a sound image localization processing unit 221 and a crosstalk compensation processing unit 222.

To localize a sound image at a desired location with respect to a user H, the sound pressure applied to the right and left external auditory meatuses of the user's H needs to be determined first. Thus, the sound image localization processing unit 221 performs the processing of generating two-channel signals in such a manner as to apply sound pressure that is high enough to localize a sound image at a desired location with respect to given sound source data.

Specifically, the sound image localization processing unit 221 functions as a plurality of (e.g., four in the example illustrated in FIG. 1) filters F11-F14 to perform the sound image localization processing. The respective filter coefficients of these filters F11-F14 correspond to the head-related transfer function of the user H who is a listener. In this embodiment, standard data of the head-related transfer function is used as the head-related transfer function of the user H. As used herein, the standard data of the head-related transfer function is data about either the average or standard value of the head-related transfer function of a person who is supposed to be the user H, and is collected statistically. Alternatively, the respective filter coefficients of the filters F11-F14 may be set based on the actually measured values of a particular user's H head-related transfer function.

To make the two-channel loudspeakers 31 and 32 emit two-channel sounds, the sound image localization processing unit 221 generates two-channel signals based on each set of the sound source data 211, 212 stored in the sound source data storage unit 21. In addition, the sound image location (i.e., the sound localization) has been determined in advance for each set of sound source data 211, 212 and the head-related transfer functions associated with these two sets of sound source data 211 and 212 are different from each other. Thus, supposing the channel corresponding to the loudspeaker 31 is a first channel and the channel corresponding to the loudspeaker 32 is a second channel, the sound image localization processing unit 221 provides two filters (namely, a first channel filter and a second channel filter) for each set of sound source data 211, 212. Consequently, the overall number of filters provided for the sound image localization processing unit 221 is equal to the product (e.g., four in the example illustrated in FIG. 1) of the number of types (e.g., two in the example illustrated in FIG. 1) of the sound source data and the number of channels (e.g., two in the example illustrated in FIG. 1). That is to say, the sound image localization processing unit 221 of this embodiment includes four filters F11-F14.

Among these four filters F11-F14, the filters F11 and F12 are provided for the first channel and the filters F13 and F14 are provided for the second channel. Furthermore, the filters F11 and F13 are provided to process the sound source data 211, while the filters F12 and F14 are provided to process the sound source data 212. In addition, the respective filter coefficients of the filters F11 and F13 are set based on the head-related transfer function such that the sound image corresponding to the sound source data 211 is localized at a predetermined location and the respective filter coefficients of the filters F12 and F14 are set based on the head-related transfer function such that the sound image corresponding to the sound source data 212 is localized at a predetermined location.

The control unit 20 may determine, according to the sound source data selected, which filters to use among the filters F11-F14 of the sound image localization processing unit 221. Alternatively, the control unit 20 may determine, according to the sound source data selected, the respective filter coefficients of the filters F11-F14 of the sound image localization processing unit 221.

In the sound image localization processing unit 221, the filters F11-F14 subject the sound source data and the filter coefficients to convolution operation, thereby generating respective first acoustic signals, each carrying information about the location of a sound image corresponding to the sound source data. For example, if the sound image corresponding to the sound source data 211 needs to be localized in a direction with an elevation angle of 30 degrees and an azimuth angle of 30 degrees as viewed from the user H, then filter coefficients corresponding to the elevation angle of 30 degrees and the azimuth angle of 30 degrees are respectively given to the filters F11 and F13 of the sound image localization processing unit 221.

Then, in the sound image localization processing unit 221, convolution operation is performed on the sound source data 211 and the respective filter coefficients of the filters F11 and F13, and convolution operation is performed on the sound source data 212 and the respective filter coefficients of the filters F12 and F14.

The sound image localization processing unit 221 further includes adders 223 and 224, each superposing, on a channel-by-channel basis, associated two of the four first acoustic signals, to which the respective filter coefficients have been convoluted by the filters F11-F14. Then, the sound image localization processing unit 221 provides the respective outputs of these two adders 223 and 224 as second acoustic signals for the two channels. This allows, when multiple sets of sound source data are selected, the sound image localization processing unit 221 to control the location of the sound image for each of multiple sounds corresponding to the multiple sets of sound source data.

The two-channel acoustic signals reach the user's H right and left ears after having been converted into sound waves by the two-channel loudspeakers 31 and 32. Thus, the sound waves emitted from the loudspeakers 31 and 32 have a different sound pressure from the sound waves reaching the user's H external auditory meatuses. That is to say, the crosstalk caused in a sound wave transmission space (reproduction system) between the loudspeakers 31 and 32 and the user H makes the sound pressure that has been set by the sound image localization processing unit 221 in view of the sound image localization different from the sound pressure of the sound waves reaching the user's H external auditory meatuses.

Thus, to localize the sound image at the location supposed by the sound image localization processing unit 221, the crosstalk compensation processing unit 222 performs compensation processing. Note that the user H is present in a listening area, which is an area for him or her to catch the sounds emitted from the two-channel loudspeakers 31 and 32.

Specifically, the crosstalk compensation processing unit 222 functions as a plurality of (e.g., four in the example illustrated in FIG. 1) filters F21-F24. Each filter coefficient of the filters F21-F24 corresponds to a compensation transfer function for reducing the crosstalk caused in the sound emitted from each of the two-channel loudspeakers 31 and 32. The crosstalk occurs when the sound emitted from each of the loudspeakers 31 and 32 reaches not only the target one of the right and left ears of the user's H but also the other ear as well. In other words, the crosstalk is caused by the transmission characteristic of the sound wave transmission space that the sound emitted from each of the loudspeakers 31 and 32 passes through before reaching the user's H ears (i.e., the characteristic of the reproduction system).

Thus, the filter F21 controls the compensation transfer function of the first channel. The filter F22 controls the compensation transfer function of the second channel. The filter F23 controls the compensation transfer function of a sound leaking from the first channel into the second channel. The filter F24 controls the compensation transfer function of a sound leaking from the second channel into the first channel. The filter coefficients of these four filters F21-F24 are determined in advance according to the characteristic of the reproduction system including the two-channel loudspeakers 31 and 32. That is to say, the crosstalk compensation processing unit 222 convolutes the compensation transfer function with respect to the second acoustic signals of the respective channels output from the sound image localization processing unit 221, thus generating four third acoustic signals. In other words, the crosstalk compensation processing unit 222 convolutes the compensation transfer function with respect to each set of sound source data 211, 212.

The crosstalk compensation processing unit 222 includes adders 225 and 226. The adders 225 and 226 each superpose, on a channel-by-channel basis, associated two of the four third acoustic signals that have been filtered through the respective filters F21-F24, thereby outputting two-channel acoustic signals.

Thus, the crosstalk compensation processing unit 222 performs crosstalk compensation processing of reducing the inter-channel crosstalk of the sound emitted from each of the two-channel loudspeakers 31 and 32 by compensating for the characteristic of the reproduction system including the two-channel loudspeakers 31 and 32. This allows the sound image of the sound corresponding to each set of sound source data, which is going to catch the user's H ears, to be localized accurately and clearly.

Then, the two-channel acoustic signals output from the adders 225 and 226 of the crosstalk compensation processing unit 222 are amplified by the amplifier unit 23. The two-channel acoustic signals, amplified by the amplifier unit 23, are input to the two-channel loudspeakers 31 and 32. As a result, respective sounds corresponding to the sound source data are emitted from the two-channel loudspeakers 31 and 32.

As described above, the virtual sound image control system 1 constitutes a transaural system. Thus, the virtual sound image control system 1 creates a sound image to be perceived, by the user H present in the listening area, as a stereophonic sound image by catching the respective sounds emitted from the two-channel loudspeakers 31 and 32.

In addition, the two-channel loudspeakers 31 and 32 according to this embodiment have the same emission direction, and the two-channel loudspeakers 31 and 32 are coaxially arranged side by side in the emission direction. Next, the virtual sound image formed by the respective sounds emitted from the two-channel loudspeakers 31 and 32 will be described.

Figure 2A:
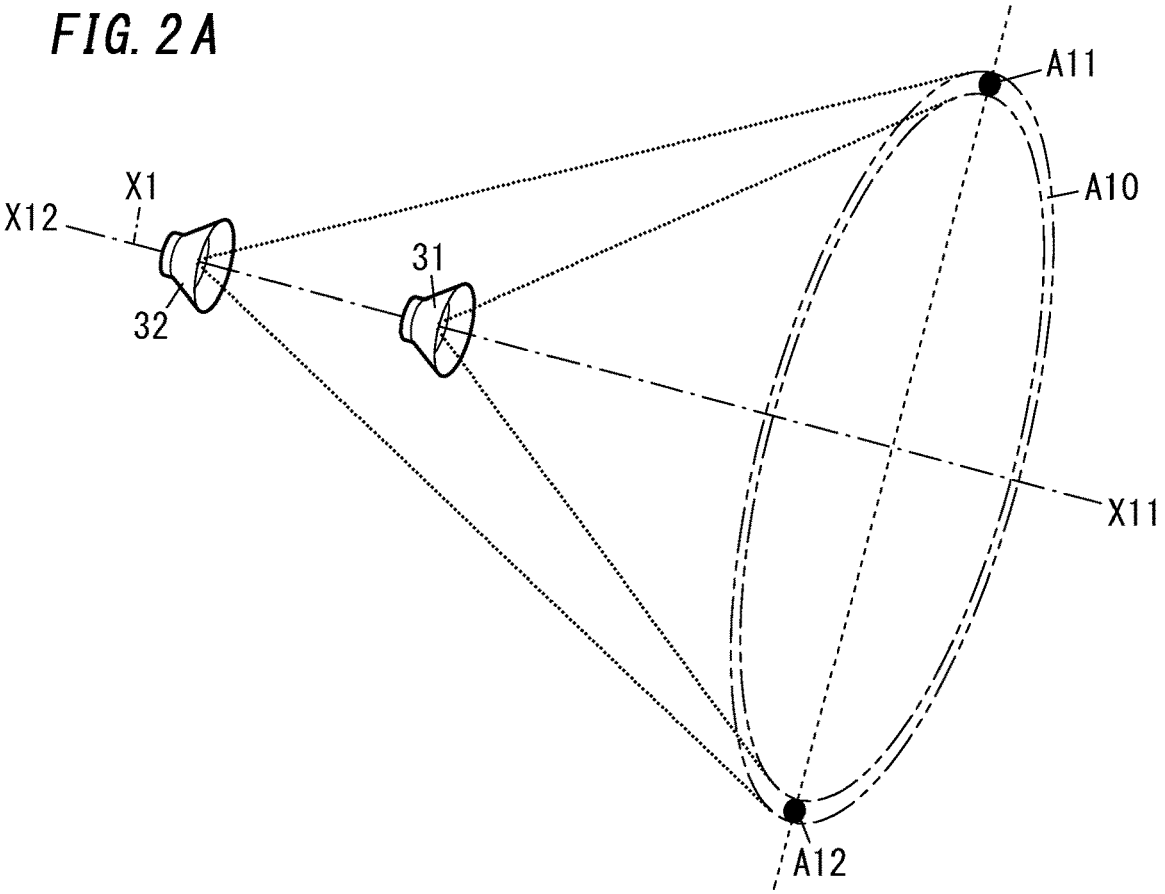
FIG. 2A illustrates how in principle the virtual sound image control system forms a virtual sound image control area.
Figure 2B:
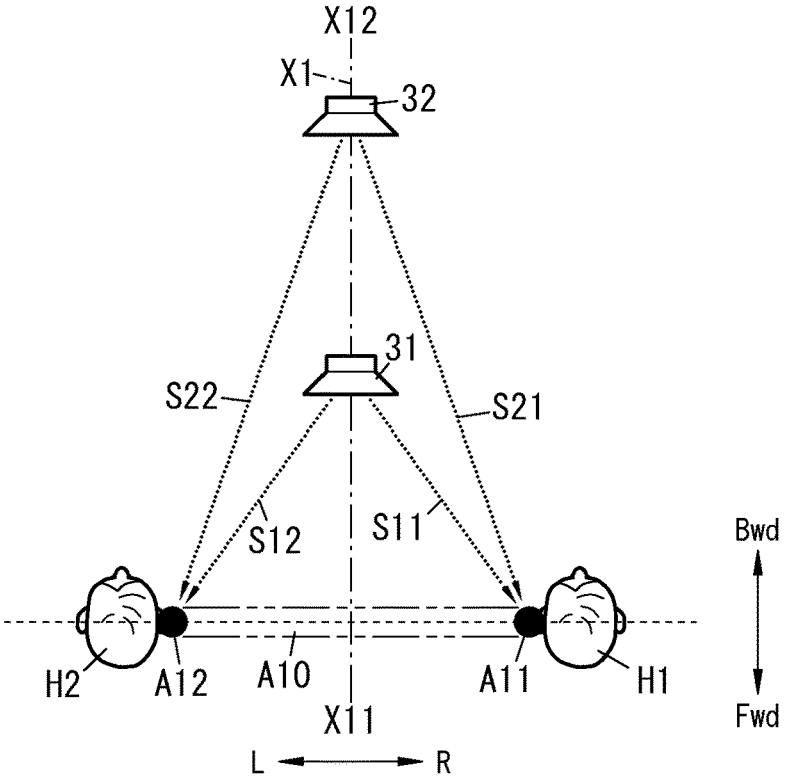
FIG. 2B is a top view of the virtual sound image control area.

FIGS. 2A and 2B illustrate how in principle, the two-channel loudspeakers 31 and 32 form the virtual sound image control area A10. As used herein, the "virtual sound image control area" refers to a collection of control points, at each of which the sound pressures, times of arrival, phases, and other parameters of the respective sounds emitted from the two-channel loudspeakers 31 and 32 are equal to each other and which serves as a listening area where the user H listens to the sounds emitted from the two-channel loudspeakers 31 and 32. Thus, the virtual sound image control system 1 creates sound images to be perceived, by a plurality of users H, whose head (suitably, both of their ears) is present in the virtual sound image control area A10, as virtually the same stereophonic sound images.

In this embodiment, each of the users H present in the virtual sound image control area A10 has his or her head (suitably both of his or her ears) located within the virtual sound image control area A10 and suitably has his or her ears arranged perpendicularly to the direction in which the loudspeakers 31 and 32 are arranged in line.

In FIG. 2A, the two-channel loudspeakers 31 and 32 each have directivity and are coaxially arranged in line. Specifically, the two-channel loudspeakers 31 and 32 are arranged side by side along a virtual line segment X1 and each emit a sound toward a first end X11 of the virtual line segment X1. That is to say, the two-channel loudspeakers 31 and 32 have the same emission direction (the same sound emission direction), and are arranged in line in the emission direction. Supposing the other end, opposite from the first end X11, of the line segment X1 is a second end X12, the loudspeaker 31 is located closer to the first end X11 than the loudspeaker 32 is, and the loudspeaker 32 is located closer to the second end X12 than the loudspeaker 31 is. In this case, the virtual sound image control area A10 is formed in the shape of an annular ring, of which the center is defined by the line segment X1, in front of the loudspeakers 31 and 32. The respective distances from the loudspeakers 31 and 32 to the center of the virtual sound image control area A10 are set at predetermined values so that the virtual sound image control area A10 serves as a listening area.

Note that the virtual sound image control area A10 is represented as either a two-dimensional space or a three-dimensional space, whichever is appropriate. When the virtual sound image control area A10 is represented as a two-dimensional space, the width of the virtual sound image control area A10 needs to fall within a range where the sound images created are perceivable, by the plurality of users H present in the virtual sound image control area A10, as virtually the same sound images. On the other hand, when the virtual sound image control area A10 is represented as a three-dimensional space, the width and thickness of the virtual sound image control area A10 need to fall within the range where the sound images created are perceivable, by the plurality of users H present in the virtual sound image control area A10, as virtually the same sound images.

Then, if a plurality of users H are present within the virtual sound image control area A10 and facing the same direction along the line segment X1, then the sound images are perceived as virtually the same sound images by the plurality of users H. Consequently, no matter where any of the users H is located in the annular virtual sound image control area A10, that location becomes a listening point where the same stereophonic sound image is perceived by the user H. Thus, the annular virtual sound image control area A10 serves as the listening areas for the users H. Note that the direction along the line segment X1 may be either the direction pointing from the first end X11 toward the second end X12 or the direction pointing from the second end X12 toward the first end X11, whichever is appropriate.

FIG. 2B is a top view of the virtual sound image control area A10 where two users H (H1, H2) are present in a situation where the line segment X1 is drawn in the forward/backward direction. These users H1 and H2 are respectively located at control points A11 and A12 within the virtual sound image control area A10. These two control points A11 and A12 are located on the same diameter of the annular virtual sound image control area A10. In the example illustrated in FIG. 2B, the user H1 is located on the right of the line segment X1 and his or her left ear is located at the control point A11, the user H2 is located on the left of the line segment X1 and his or her right ear is located at the control point A12, and these two users H1 and H2 are facing backward (i.e., the direction pointing from the first end X11 toward the second end X12).

In this case, a sound S11 emitted from the loudspeaker 31 and a sound S21 emitted from the loudspeaker 32 reach the user's H1 left ear, while a sound S12 emitted from the loudspeaker 31 and a sound S22 emitted from the loudspeaker 32 reach the user's H2 right ear. In this case, the sounds S11 and S12 are the same sound, and the sounds S21 and S22 are the same sound. That is to say, the sounds S11 and S21 reaching the user's H1 left ear from the loudspeakers 31 and 32, respectively, are the same, in terms of sound pressure, time delay, phase and other parameters, as the sounds S12 and S22 reaching the user's H2 right ear from the loudspeakers 31 and 32, respectively.

Likewise, the sounds reaching the user's H1 right ear from the loudspeakers 31 and 32, respectively, are the same, in terms of sound pressure, time delay, phase and other parameters, as the sounds reaching the user's H2 left ear from the loudspeakers 31 and 32, respectively.

Thus, virtually the same stereophonic sound images are perceived by the users H1 and H2. That is to say, the stereophonic sound images perceived by the users H1 and H2 are the same in terms of distances from the sound source, sound field depth, sound field range, and other parameters. Nevertheless, if the users H1 and H2 are listening to a sound corresponding to the same sound source data, then the sound source direction recognized by the user H1 becomes horizontally opposite from the sound source direction recognized by the user H2. For example, if the sound source direction recognized by the user H1 is upper left, then the sound source direction recognized by the user H2 is upper right.

Figure 3A:
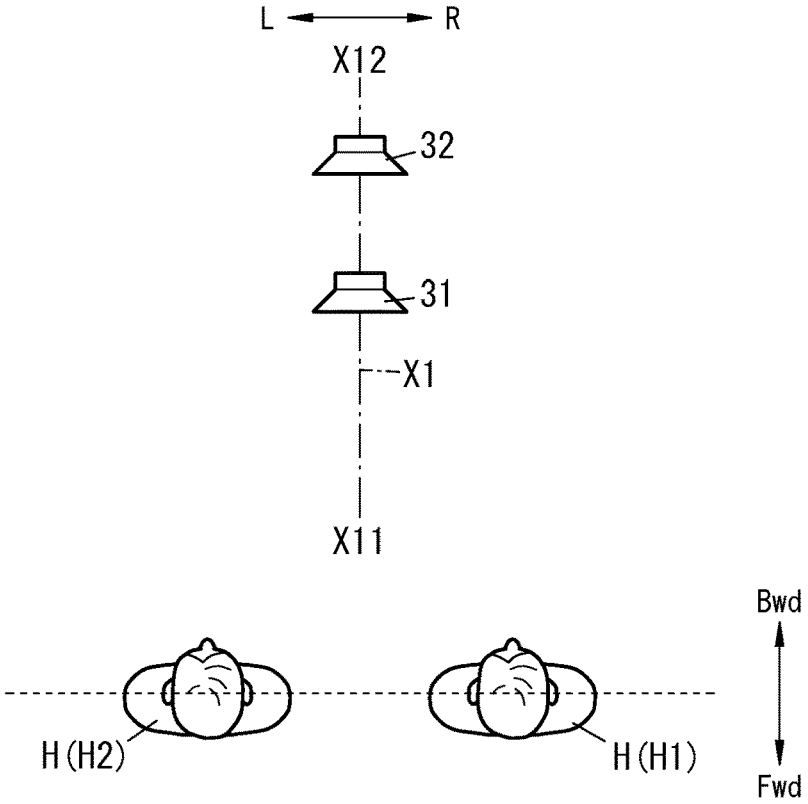
FIG. 3A is a top view illustrating an arrangement of two-channel loudspeakers in the virtual sound image control system.
Figure 3B:
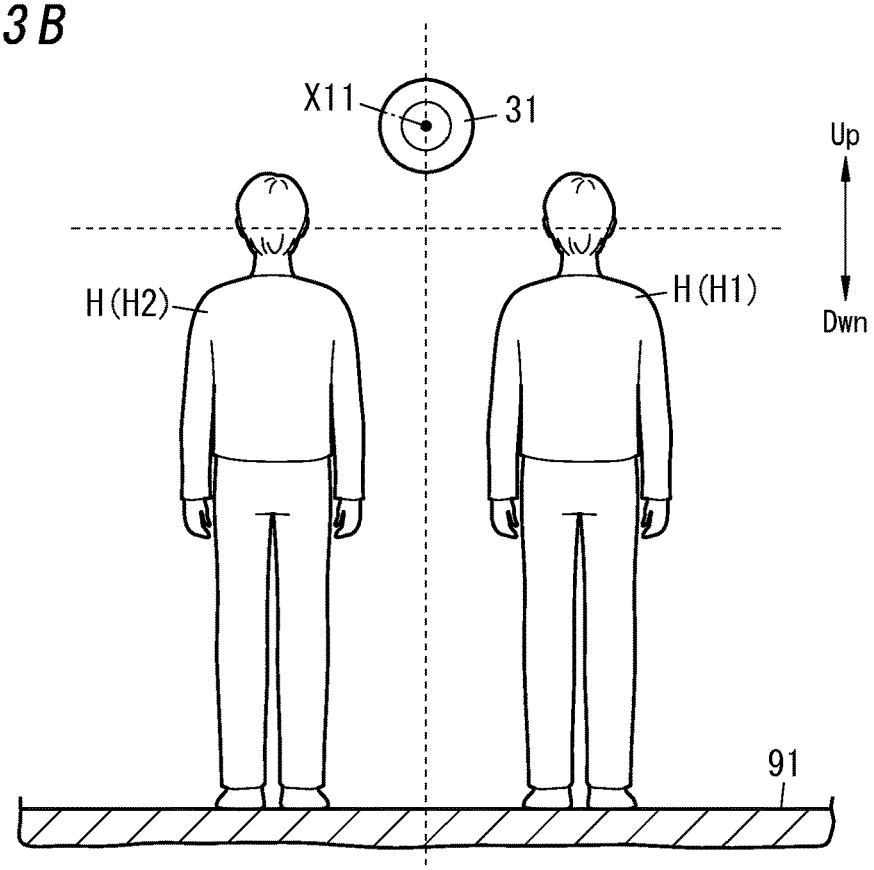
FIG. 3B is a front view illustrating the arrangement of two-channel loudspeakers in the virtual sound image control system.

FIGS. 3A and 3B illustrate another exemplary arrangement of the two-channel loudspeakers 31 and 32. In FIGS. 3A and 3B, the line segment X1 is drawn in the forward/backward direction, and the two-channel loudspeakers 31 and 32 are coaxially arranged in line in the forward/backward direction. Furthermore, the two-channel loudspeakers 31 and 32 are installed either indoors or outdoors at a predetermined height over a floor surface 91 to emit sounds in the forward direction. The two-channel loudspeakers 31 and 32 may be secured to a stand put on the floor surface 91 or a suspending fitting mounted on the lower surface of the ceiling, for example. The two-channel loudspeakers 31 and 32 are suitably installed to be roughly level with the users'

H1, H2 head or ears. In the example illustrated in FIGS. 3A and 3B, the two users H1 and H2 respectively located at control points A11 and A12 (see FIG. 2A) of the virtual sound image control area A10 are supposed to be listeners. In this case, virtually the same sound images are able to be perceived by these two users H1 and H2 standing on the floor surface 91 by catching the respective sounds emitted from the two-channel loudspeakers 31 and 32.

Figure 4A:
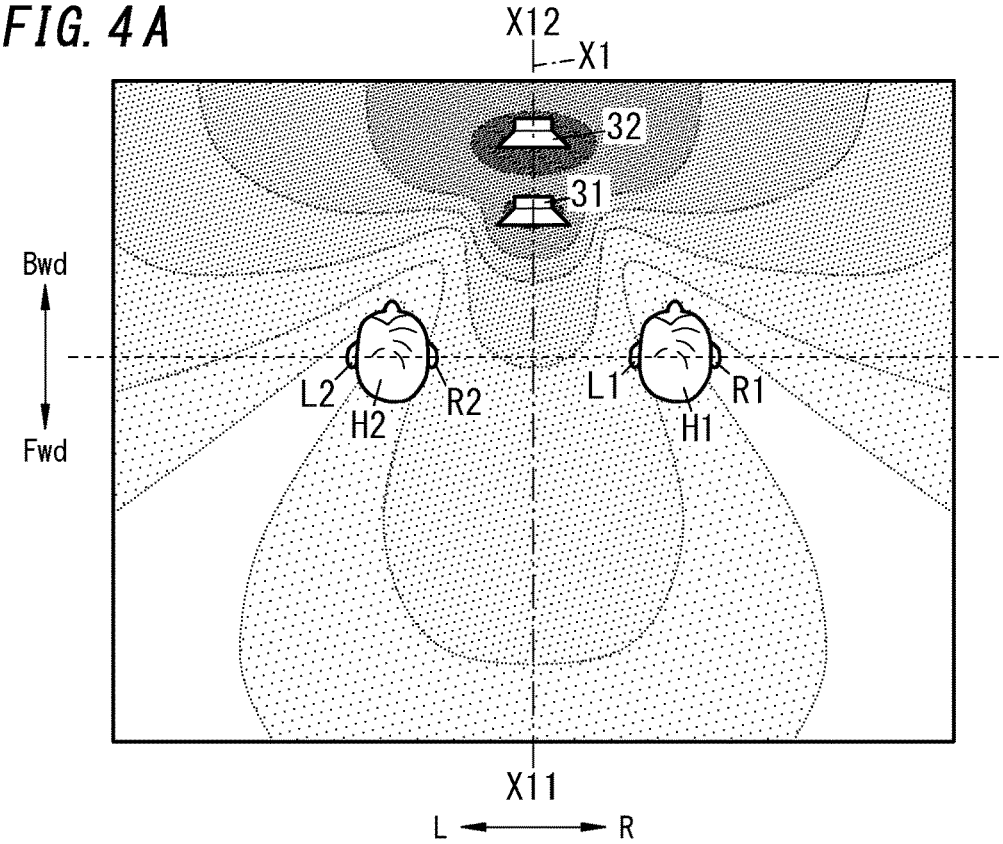
FIG. 4A illustrates a sound pressure distribution formed by the virtual sound image control system.
Figure 4B:
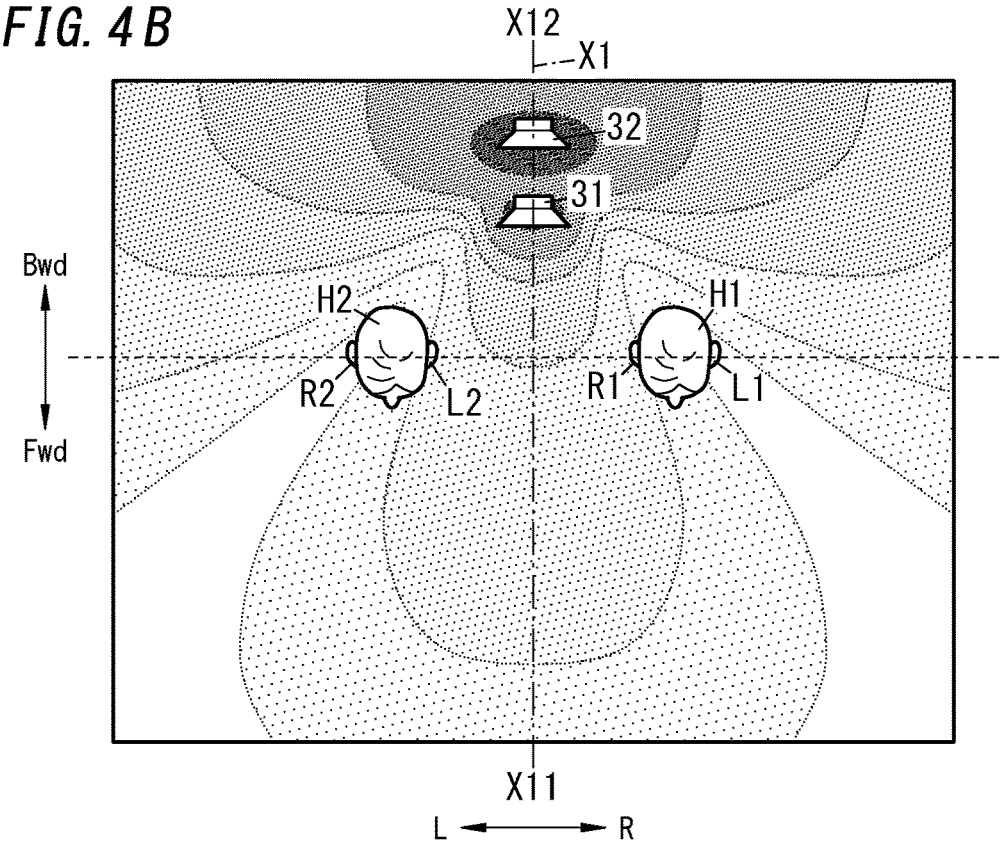
FIG. 4B illustrates another sound pressure distribution formed by the virtual sound image control system.

When the two-channel loudspeakers 31 and 32 are arranged as shown in FIGS. 3A and 3B, the sounds subjected to the sound image localization processing and the crosstalk compensation processing will have sound pressure distributions such as the ones shown in FIGS. 4A and 4B. In the examples illustrated in FIGS. 4A and 4B, the two-channel loudspeakers 31 and 32 have a horizontal emission direction, and a sound is being emitted from only the loudspeaker 32 with no sound emitted from the loudspeaker 31. Note that in a sound pressure distribution, the higher the sound pressure of a region is, the denser the dots are distributed in that region. In other words, the lower the sound pressure of a region is, the sparser the dots are distributed in that region.

In the example illustrated in FIG. 4A, the users H1 and H2, who are both facing backward, are present in front of the two-channel loudspeakers 31 and 32 and standing side by side. Specifically, the user H1 is located at the control point A11 in the virtual sound image control area A10 and the user H2 is located at the control point A12 in the virtual sound image control area A10 (see FIG. 2A). The sound emitted from the loudspeaker 32 is subjected to the sound image localization processing and the crosstalk compensation processing by the signal processor 2 so as to reach the left ear L1 of the user H1 on the right side without reaching his or her right ear R1. In this case, the sound emitted from the loudspeaker 32 reaches the right ear R2 of the user H2 on the left side without reaching his or her left ear L2. As a result, the user H1 recognizes the presence of a sound source diagonally forward left, while the user H2 recognizes the presence of a sound source diagonally forward right. That is to say, the respective sound images perceived by these two users H1 and H2 are horizontally symmetric common sound images.

In the example illustrated in FIG. 4B, the users H1 and H2, who are both facing forward, are present in front of the two-channel loudspeakers 31 and 32 and standing side by side. Specifically, the user H1 is located at the control point A11 in the virtual sound image control area A10 and the user H2 is located at the control point A12 in the virtual sound image control area A10 (see FIG. 2A). The sound emitted from the loudspeaker 32 is subjected to the sound image localization processing and the crosstalk compensation processing by the signal processor 2 so as to reach the right ear R1 of the user H1 on the right side without reaching his or her left ear L1. In this case, the sound emitted from the rear loudspeaker 32 reaches the left ear L2 of the user H2 on the left side without reaching his or her right ear R2. As a result, the user H1 recognizes the presence of a sound source diagonally backward right, while the user H2 recognizes the presence of a sound source diagonally backward left. That is to say, the respective sound images perceived by these two users H1 and H2 are the same sound images that are horizontally symmetric to each other.

Next, a variation of the first exemplary embodiment will be described with reference to FIGS. 5A and 5B. In the examples illustrated in FIGS. 5A and 5B, the emission direction of the two-channel loudspeakers 31 and 32 is the upward/downward direction, and a sound is being emitted from only the loudspeaker 32 with no sound emitted from the loudspeaker 31.

Figure 5A:
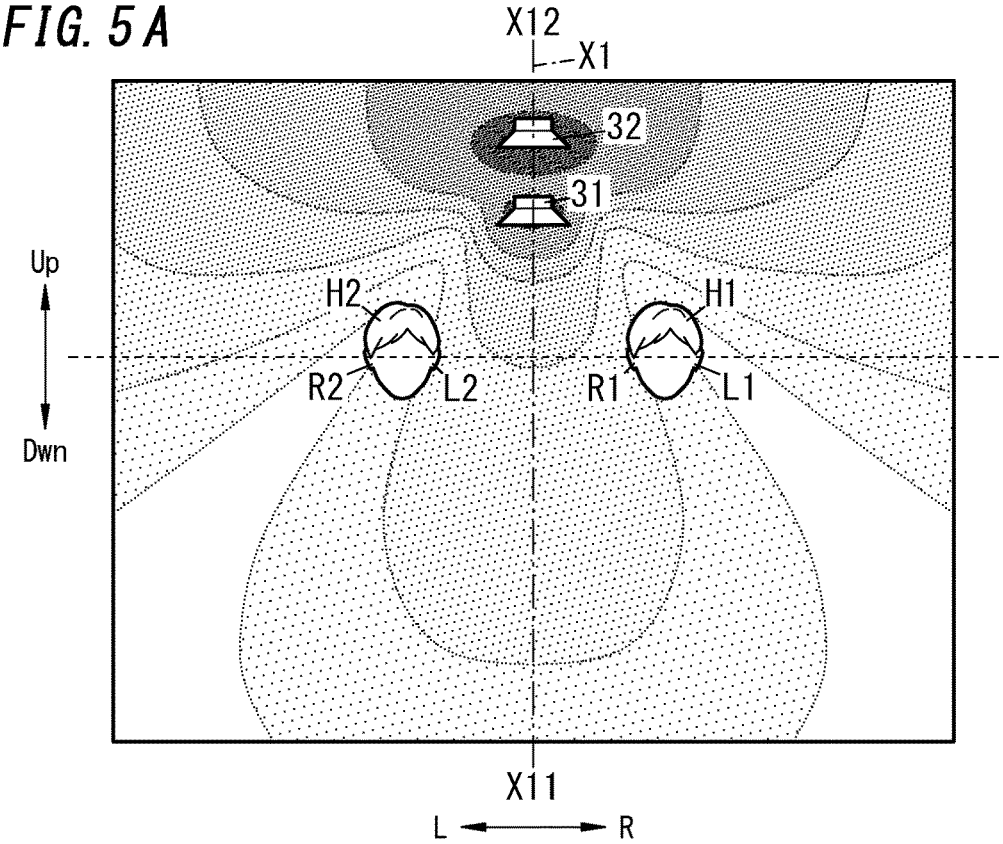
FIG. 5A illustrates a sound pressure distribution according to a variation of the first exemplary embodiment.
Figure 5B:
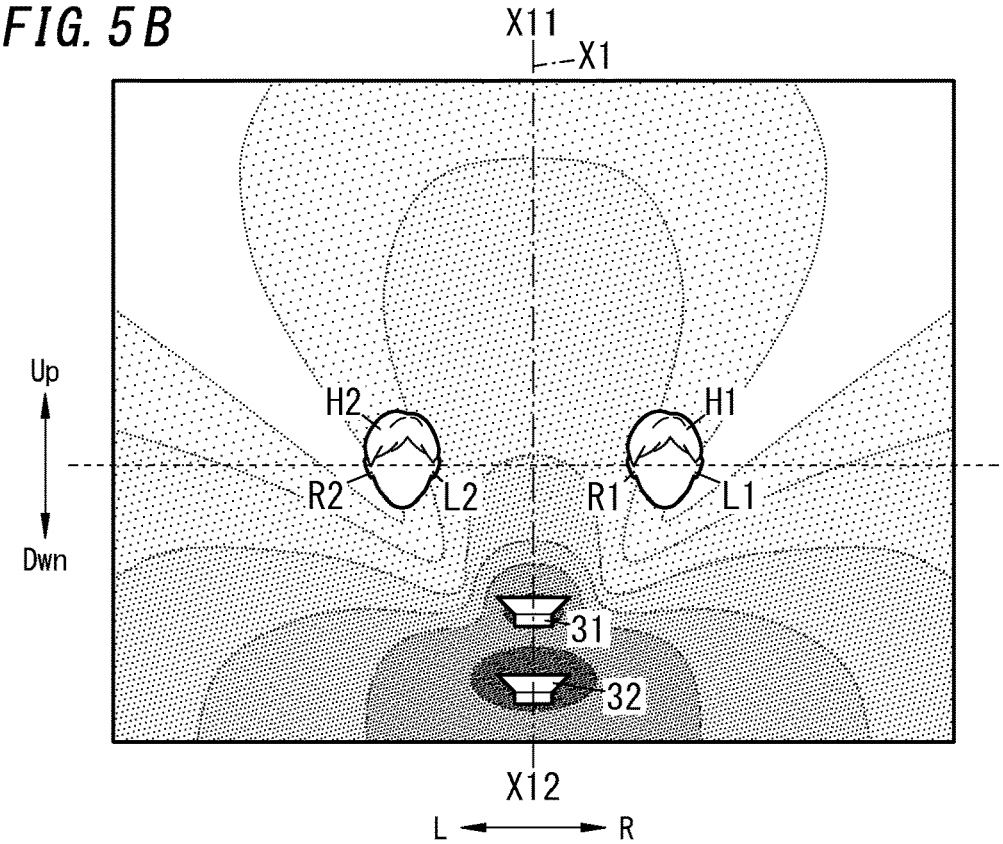
FIG. 5B illustrates another sound pressure distribution according to the variation of the first exemplary embodiment.

FIGS. 5A and 5B illustrate sound pressure distributions formed by the sound subjected to the sound image localization processing and crosstalk compensation processing by the sound image localization processing unit 221 according to this variation. In FIGS. 5A and 5B, the line segment X1 is drawn in the upward/downward direction, and the two-channel loudspeakers 31 and 32 are coaxially arranged one on top of the other in the upward/downward direction. Arranging the two-channel loudspeakers 31 and 32 coaxially one on top of the other in the upward/downward direction causes a virtual sound image control area A10 to be formed in an annular ring shape on a horizontal plane. The two-channel loudspeakers 31 and 32 may be secured to a stand put on the floor surface 91 or a suspending fitting mounted on the lower surface of the ceiling, for example.

In the example illustrated in FIG. 5A, the two-channel loudspeakers 31 and 32 are installed above the head of the users H1 and H2 to emit sounds downward. The loudspeaker 31 is located under the loudspeaker 32, and the loudspeaker 32 is located over the loudspeaker 31. The user H1 is located at the control point A11 in the virtual sound image control area A10 and the user H2 is located at the control point A12 in the virtual sound image control area A10 (see FIG. 2A). The users H1 and H2 are facing forward and are standing side by side. The sound emitted from the loudspeaker 32 is subjected to the sound image localization processing and the crosstalk compensation processing by the signal processor 2 so as to reach the right ear R1 of the user H1 on the right side without reaching his or her left ear L1. In this case, the sound emitted from the loudspeaker 32 reaches the left ear L2 of the user H2 on the left side without reaching his or her right ear R2. As a result, the user H1 recognizes the presence of a sound source diagonally upward right, while the user H2 recognizes the presence of a sound source diagonally upward left. That is to say, the respective sound images perceived by these two users H1 and H2 are virtually the same sound images that are horizontally symmetric to each other.

In the example illustrated in FIG. 5B, the two-channel loudspeakers 31 and 32 are installed below the head of the users H to emit sounds upward. The loudspeaker 31 is located over the loudspeaker 32, and the loudspeaker 32 is located under the loudspeaker 31. The user H1 is located at the control point A11 in the virtual sound image control area A10 and the user H2 is located at the control point A12 in the virtual sound image control area A10 (see FIG. 2A). The users H1 and H2 are facing forward and are standing side by side. The sound emitted from the loudspeaker 32 is subjected to the sound image localization processing and the crosstalk compensation processing by the signal processor 2 so as to reach the right ear R1 of the user H1 on the right side without reaching his or her left ear L1. In this case, the sound emitted from the loudspeaker 32 reaches the left ear L2 of the user H2 on the left side without reaching his or her right ear R2. As a result, the user H1 recognizes the presence of a sound source diagonally downward right, while the user H2 recognizes the presence of a sound source diagonally downward left. That is to say, the respective sound images perceived by these two users H1 and H2 are the sound images that are horizontally symmetric to each other.

As can be seen from the foregoing description, in the virtual sound image control system 1 according to the first exemplary embodiment, the two-channel loudspeakers 31 and 32 have the same emission direction (i.e., a single direction along the line segment X1) and the two-channel loudspeakers 31 and 32 are arranged either side by side or one on top of the other in the emission direction. Thus, the virtual sound image control system 1 according to this embodiment, having such a simple configuration with the two-channel loudspeakers 31 and 32, creates sound images to be perceived, by the plurality of users H1 and H2 present in the virtual sound image control area A10, as virtually the same stereophonic sound images.

Second Embodiment

A configuration for a virtual sound image control system 1 according to a second exemplary embodiment, as well as the system of the first exemplary embodiment, is also as shown in FIG. 1. In the following description, any constituent element of this second embodiment, having the same function as a counterpart of the first embodiment described above, will be designated by the same reference numeral as that counterpart's, and a detailed description thereof will be omitted herein.

In the second embodiment, the two-channel loudspeakers are arranged differently from in the first embodiment. Specifically, the two-channel loudspeakers 31 and 32 according to the second embodiment are arranged along a virtual line segment X2 as shown in FIGS. 6A, 6B, and 6C.

Figure 6A:
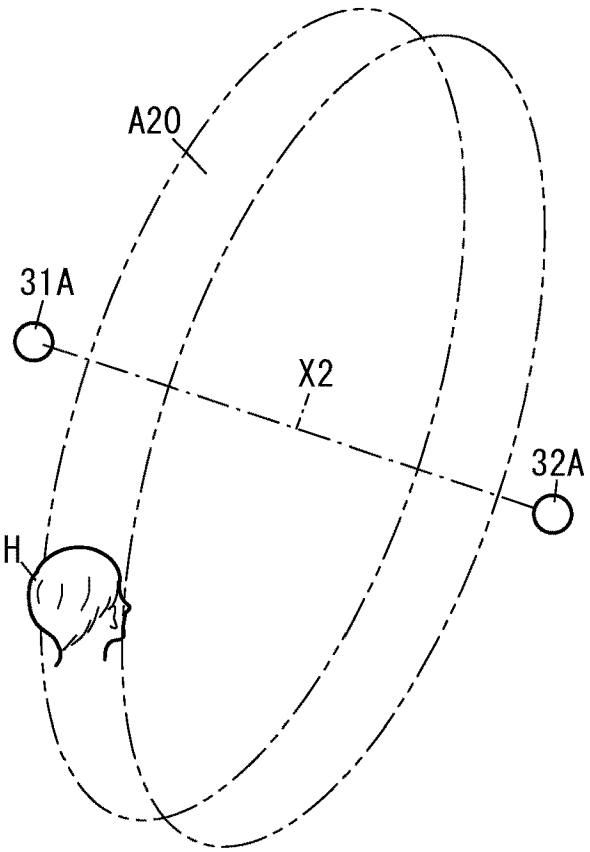
FIGS. 6A, 6B, and 6C illustrate how in principle a virtual sound image control system according to a second exemplary embodiment forms a virtual sound image control area.
Figure 6B:
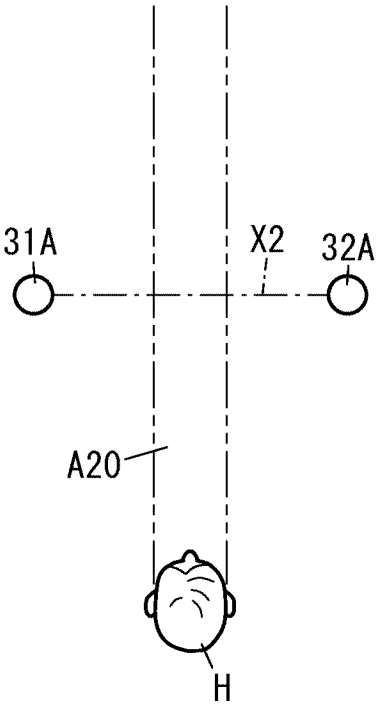
Figure 6C:
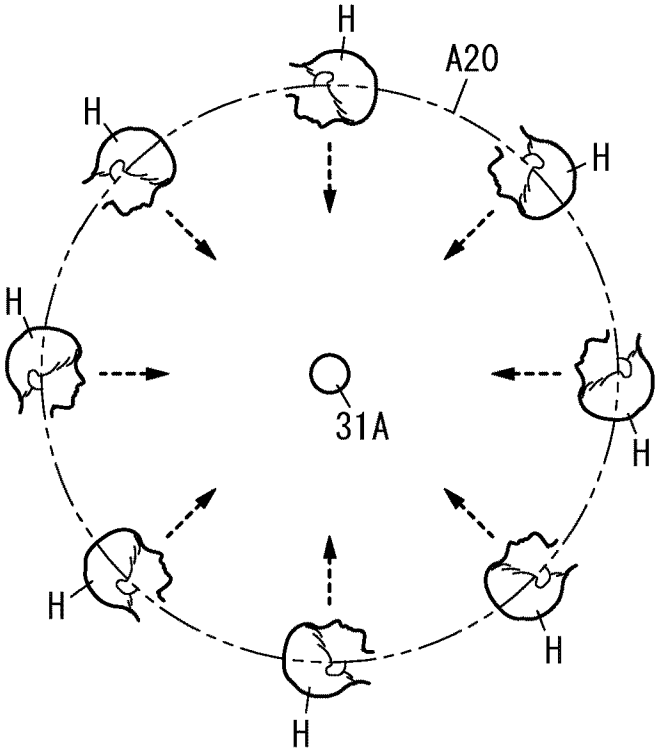

FIGS. 6A, 6B, and 6C illustrate how in principle, a virtual sound image control area A20 is formed by non-directional two-channel loudspeakers 31A and 32A arranged along the line segment X2. Since each of the two-channel loudspeakers 31A and 32A is non-directional (i.e., functions as a point sound source), the virtual sound image control area A20 comes to have the shape of an annular ring, of which the center is defined by the line segment X2. Note that in FIGS. 6A, 6B, and 6C, the midpoint of the line segment connecting the loudspeakers 31A and 32A together defines the center of the annular virtual sound image control area A20.

Also, if a plurality of users H present in the virtual sound image control area A20 are all facing perpendicularly to the line segment X2, then the respective sound images perceived by the users H become virtually the same sound images. Consequently, no matter where any of the plurality of users H is located in the annular virtual sound image control area A20, that location becomes a listening point where the same stereophonic sound image is perceived by the user H. Thus, the annular virtual sound image control area A20 serves as the listening areas for the users H.

Therefore, the stereophonic sound images perceived by the plurality of users H in the virtual sound image control area A20 are virtually the same sound images. Note that the plurality of users H present in the virtual sound image control area A20 suitably have their head (suitably, both of their ears) located in the virtual sound image control area A20, and suitably have their ears arranged parallel to the direction in which the loudspeakers 31A and 32A are arranged side by side.

Note that the virtual sound image control area A20 is represented as either a two-dimensional space or a three-dimensional space, whichever is appropriate. When the virtual sound image control area A20 is represented as a two-dimensional space, the width of the virtual sound image control area A20 needs to fall within a range where the sound images created are perceivable, by the plurality of users H present in the virtual sound image control area A20, as virtually the same sound images. On the other hand, when the virtual sound image control area A20 is represented as a three-dimensional space, the width and thickness of the virtual sound image control area A20 need to fall within the range where the sound images created are perceivable, by the plurality of users H present in the virtual sound image control area A20, as virtually the same sound images.

Figure 7A:
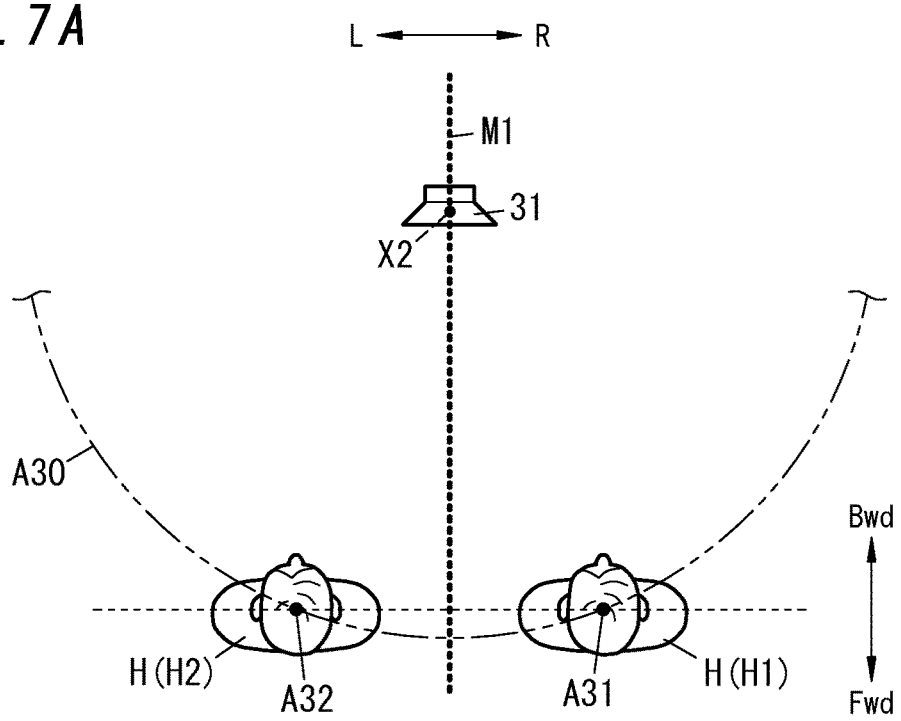
FIG. 7A is a top view illustrating the virtual sound image control area of the virtual sound image control system.
Figure 7B:
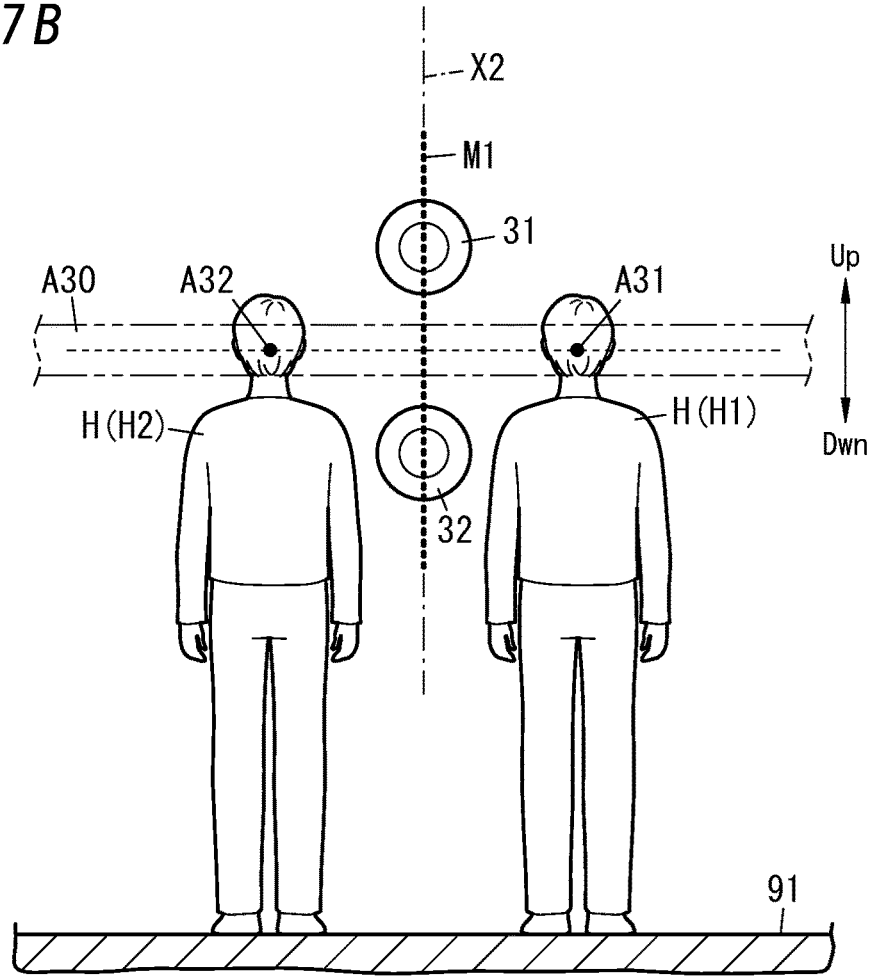
FIG. 7B is a front view illustrating the virtual sound image control area.

FIGS. 7A and 7B illustrate an exemplary arrangement of two-channel loudspeakers 31 and 32 with directivity. In this example, the line segment X2 is drawn in the upward/downward direction, and the two-channel loudspeakers 31 and 32 are arranged one on top of the other in the upward/downward direction. The emission direction of each of the two-channel loudspeakers 31 and 32 is horizontal direction and points to the same direction.

Specifically, the two-channel loudspeakers 31 and 32 are installed either indoors or outdoors at a predetermined height over a floor surface 91 to emit sounds in the forward direction. The loudspeaker 31 is arranged over the loudspeaker 32. In other words, the loudspeaker 32 is arranged under the loudspeaker 31. More specifically, the loudspeaker 31 is suitably arranged above the head or ears of the users H, and the loudspeaker 31 is suitably arranged below the head or ears of the users H.

In the example illustrated in FIGS. 7A and 7B, the two users H1 and H2 are supposed to be listeners, who are present in front of the two-channel loudspeakers 31 and 32 and are both facing backward. The two-channel loudspeakers 31 and 32 each emit a sound forward, thus forming an arc-shaped virtual sound image control area A30 (which forms part of the annular virtual sound image control area A20) in front of the two-channel loudspeakers 31 and 32. The arc-shaped virtual sound image control area A30 is formed within a horizontal plane perpendicular to the line segment X2, and a point on the line segment X2 defines the center of the arc-shaped virtual sound image control area A30. The users H1 and H2 are both present in the virtual sound image control area A30. In the example illustrated in FIGS. 7A and 7B, the user H1 is located on the right of the line segment X2 and the user H2 is located on the left of the line segment X2.

Note that the virtual sound image control area A30 is represented as either a two-dimensional space or a three-dimensional space, whichever is appropriate. When the virtual sound image control area A30 is represented as a two-dimensional space, the width of the virtual sound image control area A30 needs to fall within a range where the sound images created are perceivable, by the plurality of users H present in the virtual sound image control area A30, as virtually the same sound images. On the other hand, when the virtual sound image control area A30 is represented as a three-dimensional space, the width and thickness of the virtual sound image control area A30 need to fall within the range where the sound images created are perceivable, by the plurality of users H present in the virtual sound image control area A30, as virtually the same sound images.

Suppose a plane including the virtual line segment X2 connecting the two-channel loudspeakers 31 and 32 together and defined to extend in the upward/downward direction and the forward/backward direction is a virtual plane M1. In that case, in the virtual sound image control area A30, a first listening area A31 and a second listening area A32 are formed symmetrically with respect to the virtual plane M1. In the example illustrated in FIGS. 7A and 7B, the user H1 is located in the first listening area A31 and the user H2 is located in the second listening area A32. Thus, the sound images created are perceivable, by the users H1 and H2 on the floor surface 91, as virtually the same sound images by catching the sounds emitted from the two-channel loudspeakers 31 and 32. That is to say, the stereophonic sound images perceived by the users H1 and H2 are the same in terms of distances from the sound source, sound field depth, sound field range, and other parameters. Nevertheless, if the users H1 and H2 are listening to a sound corresponding to the same sound source data, then the sound source direction recognized by the user H1 becomes horizontally opposite from the sound source direction recognized by the user H2. For example, if the sound source direction recognized by the user H1 is upper left, then the sound source direction recognized by the user H2 is upper right.

In this embodiment, the plurality of users H present in the virtual sound image control area A30 suitably have their head (suitably, both of their ears) located in the virtual sound image control area A30, and suitably have their ears arranged perpendicularly to the direction in which the loudspeakers 31 and 32 are arranged one on top of the other.

Next, a variation of the second embodiment will be described with reference to FIGS. 8A, 8B, 9A, and 9B.

In this variation, the line segment X2 passing through the two-channel loudspeakers 31 and 32 is drawn horizontally (in the rightward/leftward direction) and the emission direction of each of the two-channel loudspeakers 31 and 32 is the upward direction. That is to say, the two-channel loudspeakers 31 and 32 are arranged side by side horizontally and the emission direction of the two-channel loudspeakers 31 and 32 is the upward direction and points to the same direction.

Arranging the two-channel loudspeakers 31 and 32 side by side in the rightward/leftward direction along the line segment X2 causes the virtual sound image control area A30 to be formed in an arc shape on a vertical plane. In addition, the virtual plane M1 is formed to extend in the upward/downward direction and the rightward/leftward direction. The first listening area A31 and the second listening area A32 are formed symmetrically with respect to the virtual plane M1 within the virtual sound image control area A30. In the example illustrated in FIGS. 8A, 8B, 9A, and 9B, the user H1 is located in the first listening area A31 behind the virtual plane M1 and the user H2 is located in the second listening area A32 in front of the virtual plane M1. Also, the loudspeaker 31 is arranged on the right of the loudspeaker 32. In other words, the loudspeaker 32 is arranged on the left of the loudspeaker 31.

FIGS. 8A, 8B, 9A, and 9B illustrate sound pressure distributions formed by the sounds subjected to the sound image localization processing by the sound image localization processing unit 221 according to this variation. In the examples illustrated in FIGS. 8A, 8B, 9A, and 9B, a sound is emitted from the loudspeaker 32 with no sound emitted from the loudspeaker 31.

Figure 8A:
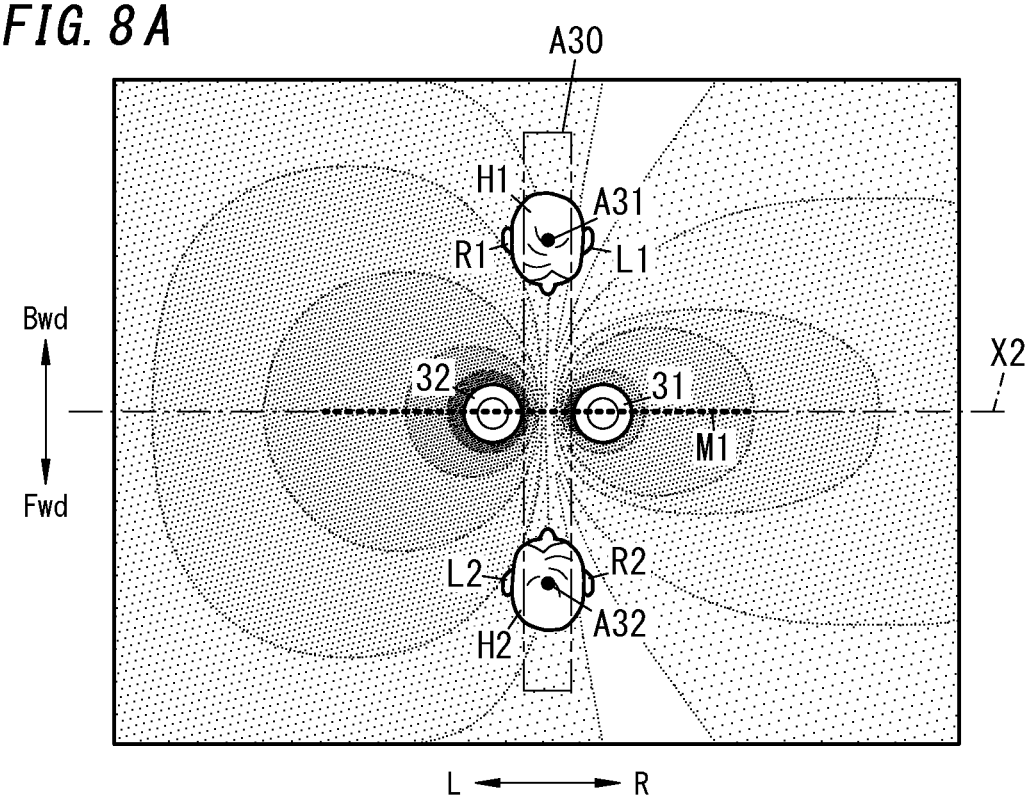
FIG. 8A illustrates a sound pressure distribution according to a variation of the second exemplary embodiment.
Figure 8B:
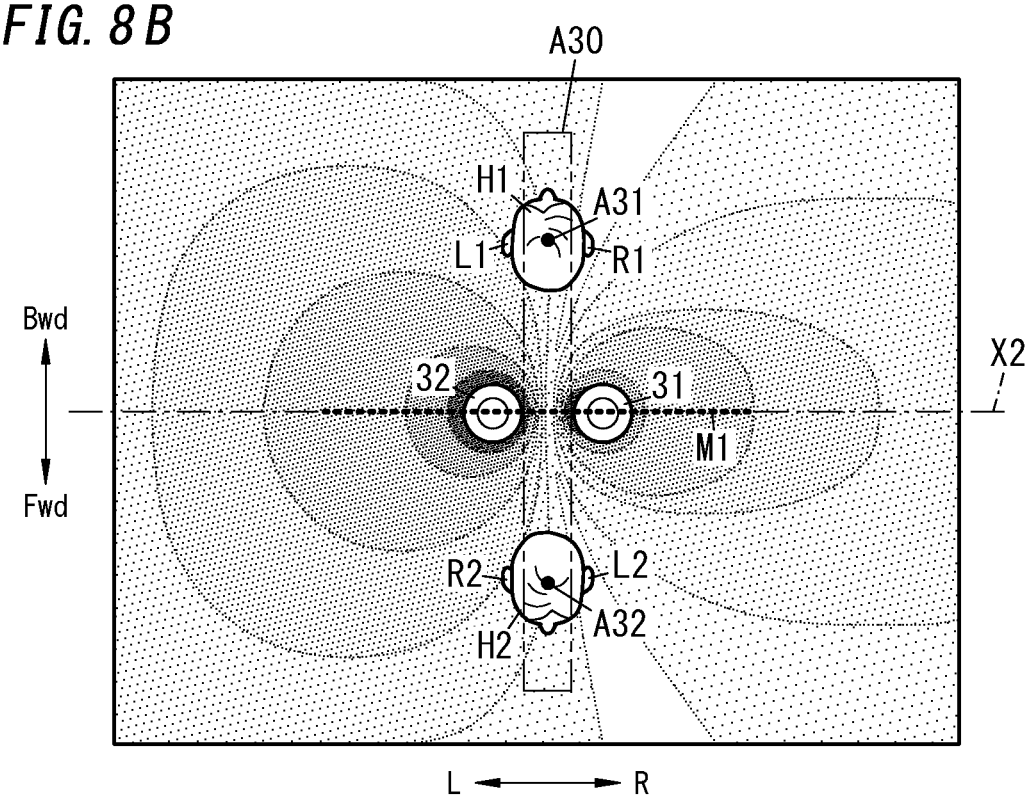
FIG. 8B illustrates another sound pressure distribution according to the variation of the second exemplary embodiment.

First of all, in the examples illustrated in FIGS. 8A and 8B, the users H1 and H2 are supposed to be either standing or seated.

In the example illustrated in FIG. 8A, the user H1 is facing forward, the user H2 is facing backward, and therefore, these two users H1 and H2 are facing each other in the forward/backward direction. In addition, the sound emitted from the loudspeaker 32 is subjected to the sound image localization processing and the crosstalk compensation processing by the signal processor 2 so as to reach the right ear R1 of the user H1 without reaching his or her left ear L1. In this case, the sound emitted from the loudspeaker 32 reaches the left ear L2 of the user H2 without reaching his or her right ear R2.

In the example illustrated in FIG. 8B, the user H1 is facing backward, the user H2 is facing forward, and therefore, these two users H1 and H2 are standing or seated back to back (i.e., facing away from each other). In addition, the sound emitted from the loudspeaker 32 is subjected to the sound image localization processing and the crosstalk compensation processing by the signal processor 2 so as to reach the left ear L1 of the user H1 without reaching his or her right ear R1. In this case, the sound emitted from the loudspeaker 32 reaches the right ear R2 of the user H2 without reaching his or her left ear L2.

Figure 9A:
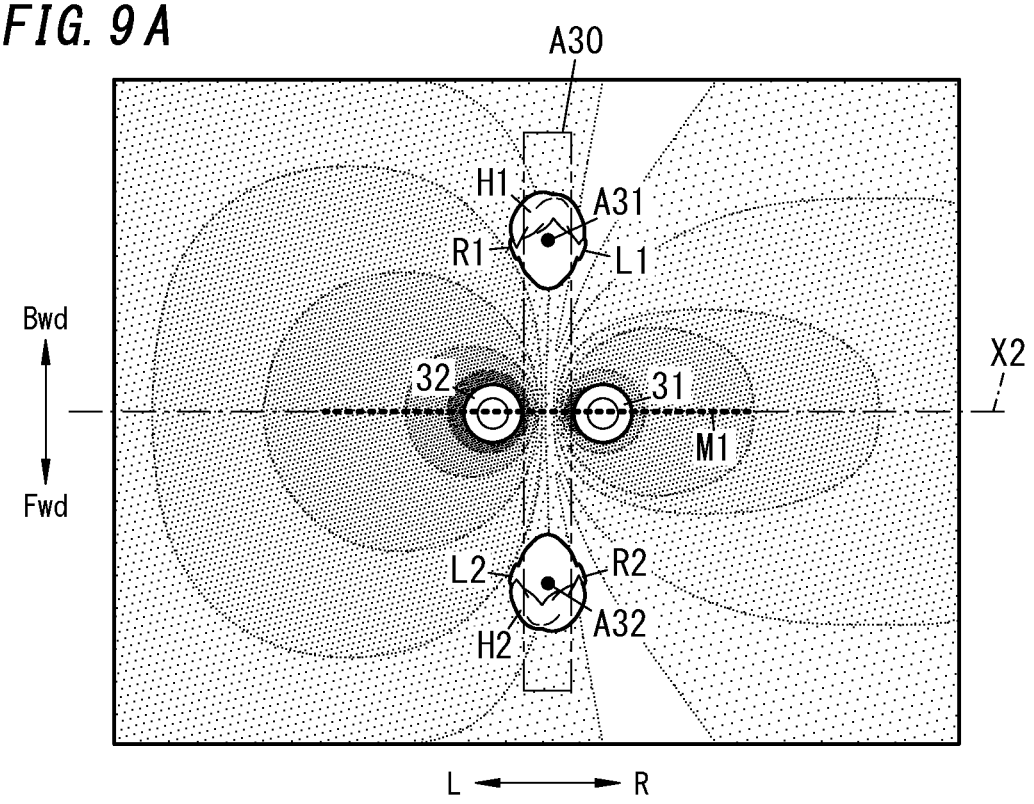
FIG. 9A illustrates a sound pressure distribution according to another variation of the second exemplary embodiment.
Figure 9B:
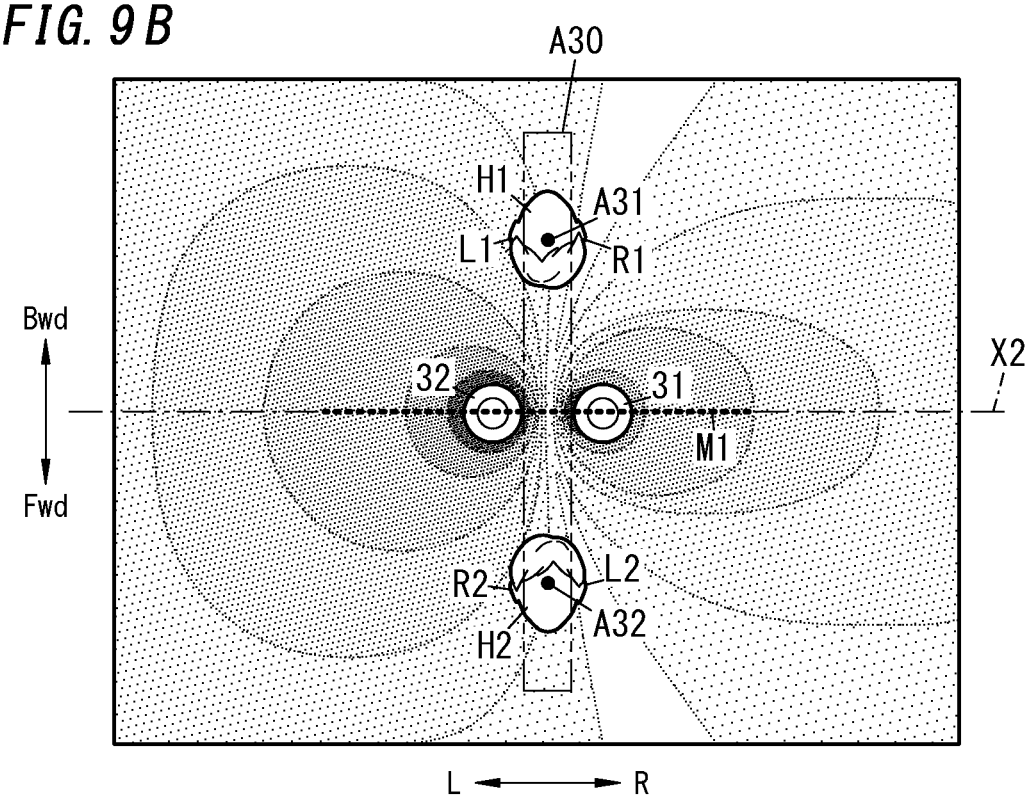
FIG. 9B illustrates another sound pressure distribution according to the variation of the second exemplary embodiment.

Next, in the examples illustrated in FIGS. 9A and 9B, the users H1 and H2 are supposed to be either lying or sleeping on bed.

In the example illustrated in FIG. 9A, the users H1 and H2 are both facing upward, and the users' H1 and H2 are both facing upward with their legs extended in two opposite directions. In addition, the sound emitted from the loudspeaker 32 is subjected to the sound image localization processing and the crosstalk compensation processing by the signal processor 2 so as to reach the right ear R1 of the user H1 without reaching his or her left ear L1. In this case, the sound emitted from the loudspeaker 32 reaches the left ear L2 of the user H2 without reaching his or her right ear R2.

In the example illustrated in FIG. 9B, the users H1 and H2 heads are pointing to mutually opposite directions. In addition, the sound emitted from the loudspeaker 32 is subjected to the sound image localization processing and the crosstalk compensation processing by the signal processor 2 so as to reach the left ear L1 of the user H1 without reaching his or her right ear R1. In this case, the sound emitted from the loudspeaker 32 reaches the right ear R2 of the user H2 without reaching his or her left ear L2.

In all of these examples illustrated in FIGS. 8A, 8B, 9A, and 9B, the sound image perceived by the user H1 and the sound image perceived by the user H2 are the same images that are horizontally symmetric to each other.

The variation described above may be modified such that the loudspeakers 31 and 32 are installed over the users H to emit sounds downward.

As can be seen from the foregoing description, in the virtual sound image control system 1 according to this second exemplary embodiment, the first listening area A31 and second listening area A32 of the user H1 are formed symmetrically with respect to the virtual plane M1 including the virtual line segment X2 that connects the two-channel loudspeakers 31 and 32 together.

Thus, the virtual sound image control system 1 according to this embodiment, having such a simple configuration with the two-channel loudspeakers 31 and 32, creates sound images to be perceived, by the plurality of users H1 and H2, as virtually the same stereophonic sound images.

Third Embodiment

A third exemplary embodiment to be described below relates to exemplary applications of the virtual sound image control system 1.

Figure 10:
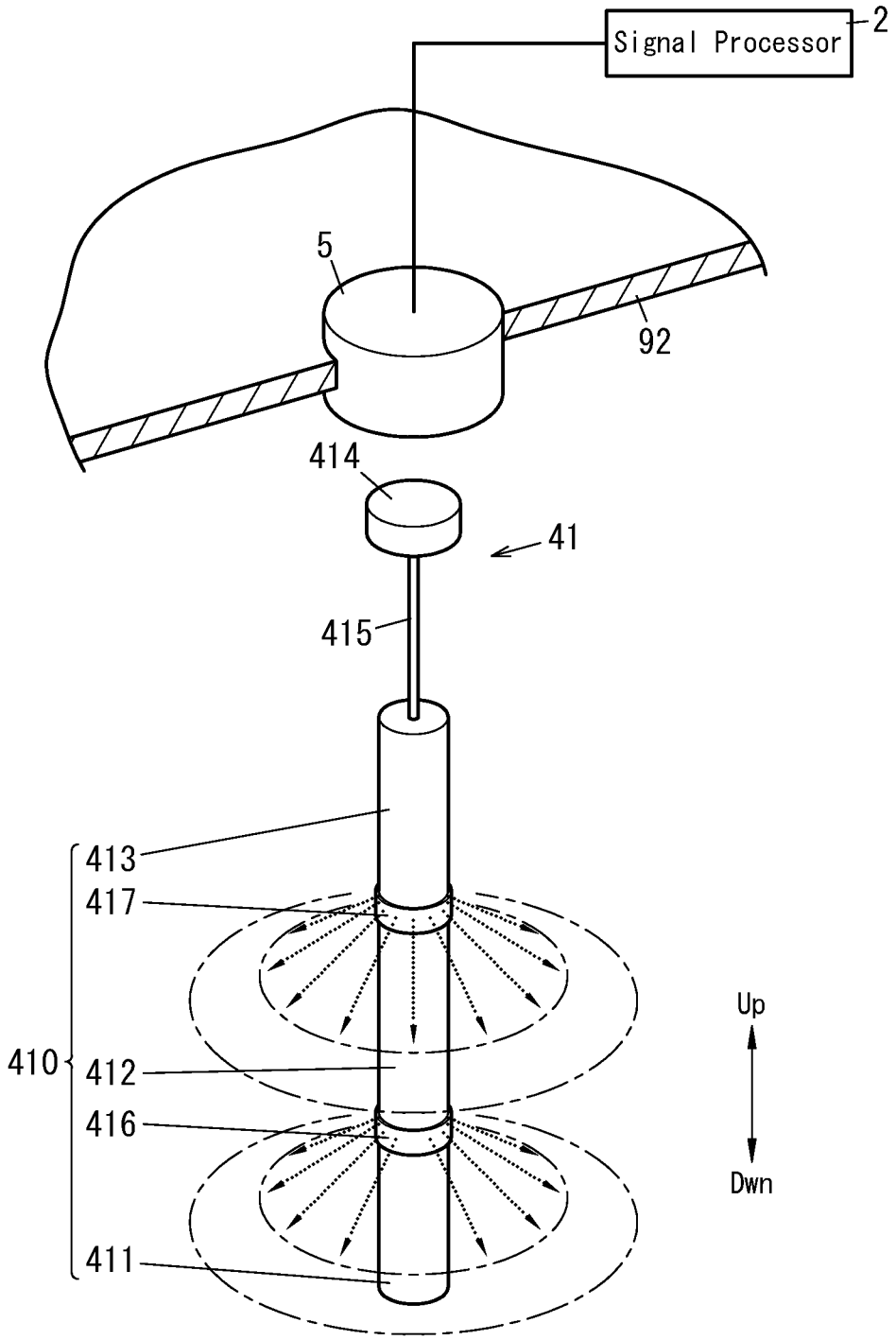
FIG. 10 is a perspective view illustrating a configuration for a light fixture according to a third exemplary embodiment.

FIG. 10 illustrates a pendant light fixture 41 as a first exemplary application. The light fixture 41 includes a light source unit 411, a first loudspeaker unit 412, a second loudspeaker unit 413, a plug 414, a cable 415, a first connector unit 416, and a second connector unit 417. The upper end of the light source unit 411 and the lower end of the first loudspeaker unit 412 are connected together via the first connector unit 416. The upper end of the first loudspeaker unit 412 and the lower end of the second loudspeaker unit 413 are connected together via the second connector unit 417. The light source unit 411, the first loudspeaker unit 412, the second loudspeaker unit 413, the first connector unit 416, and second connector unit 417 together form a light fixture body 410. One end of the cable 415 is inserted through the upper surface of the second loudspeaker unit 413 into the light fixture body 410 and the plug 414 is attached to the other end of the cable 415. The cable 415 includes a plurality of electric wires therein.

The plug 414 is electrically and mechanically connected to a receptacle 5 mounted on a ceiling surface 92. The plug 414 receives power (lighting power) to light the light fixture 41 from the receptacle 5 and supplies the lighting power to the light fixture body 410 through the cable 415. Furthermore, the signal processor 2 of the virtual sound image control system 1 outputs two-channel acoustic signals to the light fixture body 410 via the receptacle 5, the plug 414, and the cable 415.

Figure 11:
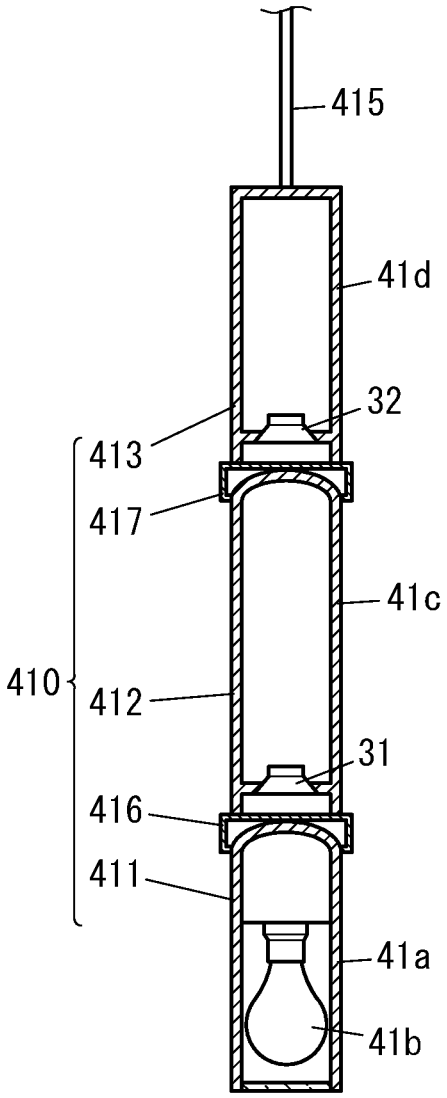
FIG. 11 is a cross-sectional view illustrating a configuration for the light fixture.

FIG. 11 illustrates a configuration for the light fixture body 410. The light source unit 411 includes a casing 41*a* and a light source 41*b*. The casing 41*a* has the shape of a hollow cylinder and is made of a light-transmitting material that transmits visible radiation. The light source 41*b* is housed inside the casing 41*a*. The light source 41*b* includes a plurality of LED elements and is lit when supplied with the lighting power through the cable 415.

The first loudspeaker unit 412 includes a casing 41*c* and the loudspeaker 31. The casing 41*c* is a hollow cylindrical member and houses the loudspeaker 31 therein. The loudspeaker 31 is exposed through the lower surface of the casing 41*c* toward the inside of the first connector unit 416, and emits a sound downward. The first connector unit 416 is formed in a cylindrical shape and has a plurality of sound holes cut through a side surface thereof. The sound emitted from the loudspeaker 31 is transmitted through the plurality of sound holes of the first connector unit 416 into the external environment. In that case, the internal space of the first connector unit 416 forms a front air chamber and the internal space of the casing 41*c* forms a rear air chamber.

The second loudspeaker unit 413 includes a casing 41*d* and the loudspeaker 32. The casing 41*d* is a hollow cylindrical member and houses the loudspeaker 32 therein. The loudspeaker 32 is exposed through the lower surface of the casing 41*d* toward the inside of the second connector unit 417, and emits a sound downward. The second connector unit 417 is formed in a cylindrical shape and has a plurality of sound holes cut through a side surface thereof. The sound emitted from the loudspeaker 32 is transmitted through the plurality of sound holes of the second connector unit 417 into the external environment. In that case, the internal space of the second connector unit 417 forms a front air chamber and the internal space of the casing 41*d* forms a rear air chamber.

The loudspeakers 31 and 32 respectively receive the two-channel acoustic signals from the signal processor 2 and emit sounds reproduced from the acoustic signals.

In this light fixture 41, the loudspeakers 31 and 32 are coaxially arranged one on top of the other in the upward/downward direction. Thus, an annular virtual sound image control area A10 is formed on a horizontal plane as in the first embodiment described above.

Figure 12A:
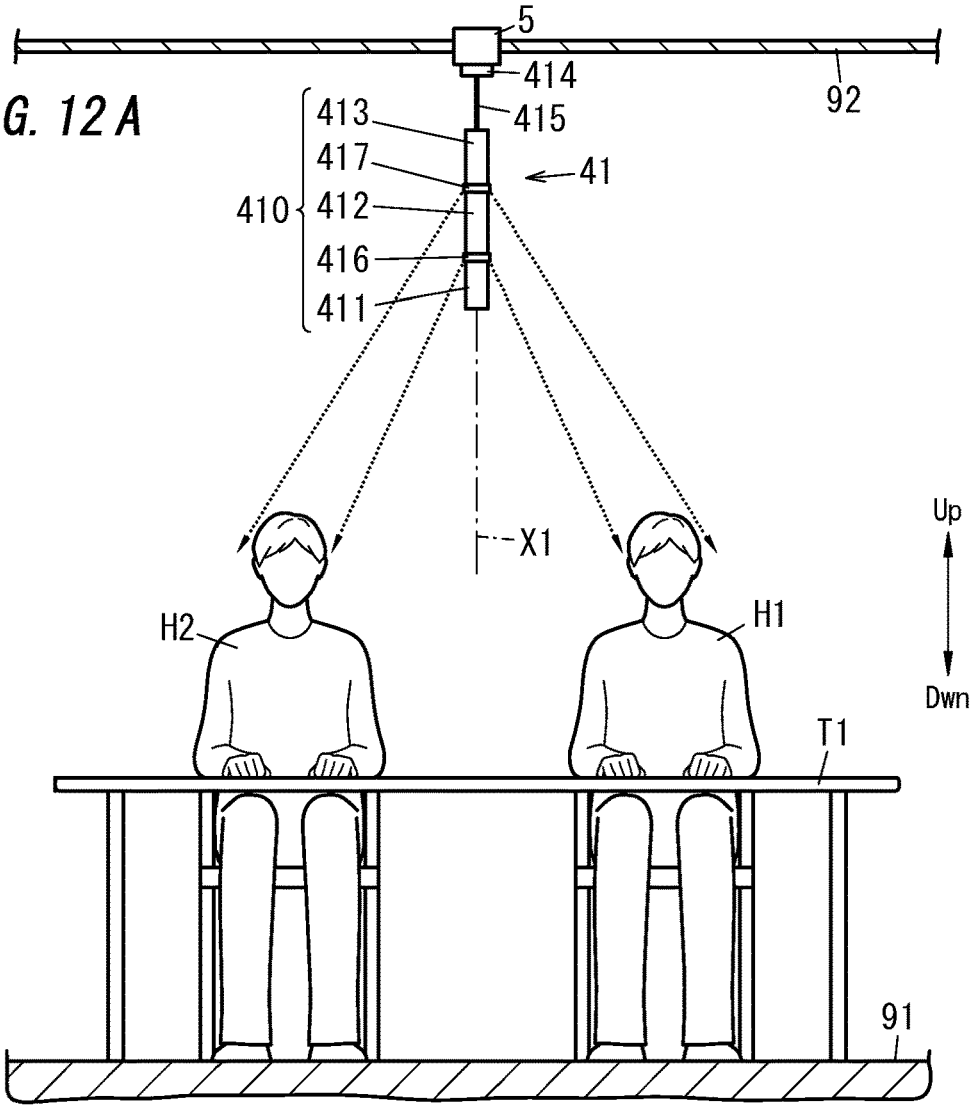
FIG. 12A is a front view illustrating how the light fixture is installed.
Figure 12B:
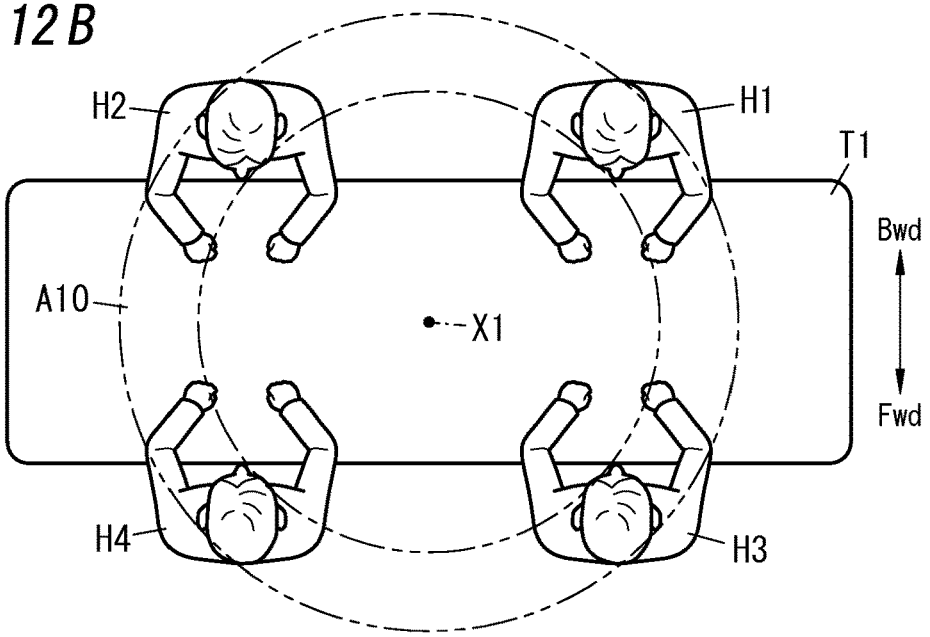
FIG. 12B is a top view illustrating a virtual sound image area of the light fixture.

In the example illustrated in FIG. 12A, the light fixture 41 is installed over a central region of a table (dining table) T1. In this case, the two-channel loudspeakers 31 and 32 are arranged one on top of the other along a virtual line segment X1 extending in the upward/downward direction and emit sounds downward. Thus, as shown in FIG. 12B, an annular virtual sound image control area A10, of which the center axis is defined by the line segment X1, is formed on a horizontal plane.

In addition, in this example, four users H1-H4 are present in the virtual sound image control area A10 and sitting at the table T1 to face each other two by two. In this case, the sound images created are perceived, by the plurality of users H1-H4, as virtually the same sound images.

Figure 13A:
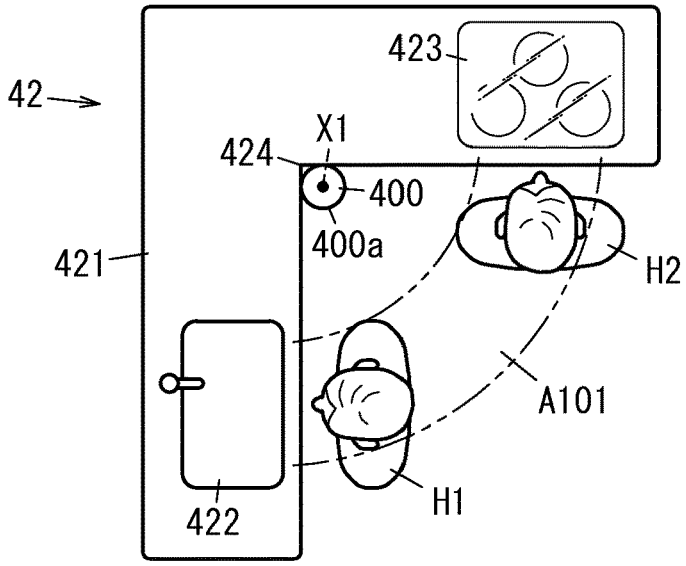
FIG. 13A is a top view illustrating a configuration for a kitchen system.
Figure 13B:
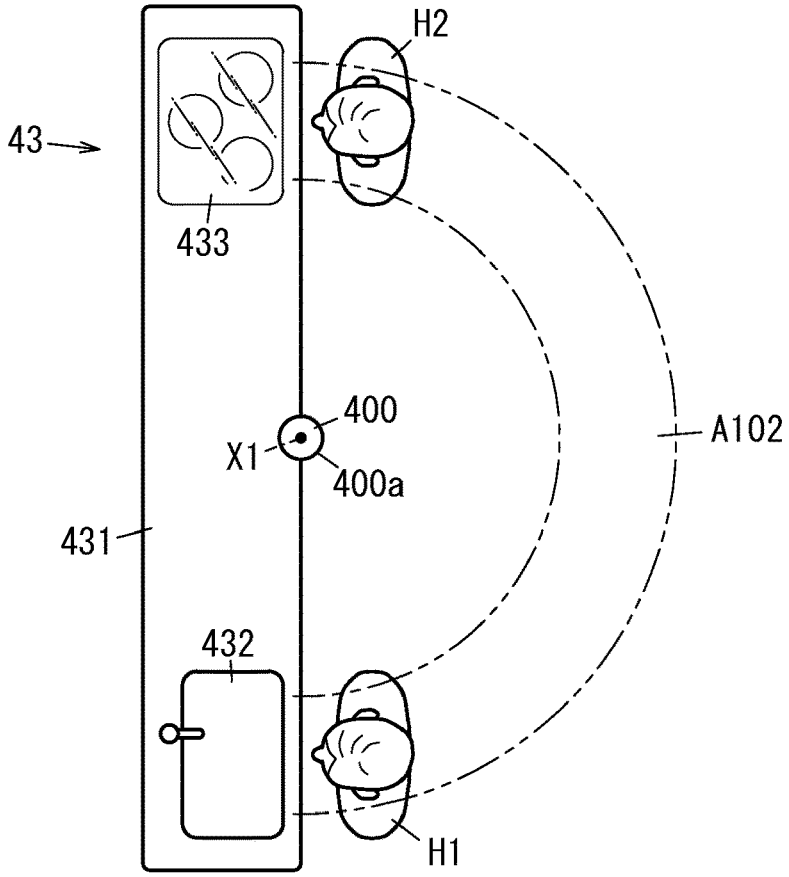
FIG. 13B is a top view illustrating another configuration for the kitchen system.

FIGS. 13A and 13B illustrate, as a second exemplary application, kitchen systems.

The kitchen system 42 illustrated in FIG. 13A includes an L-shaped kitchen counter 421. One side of the L-shaped kitchen counter 421 has a sink 422 and the other side of the L-shaped kitchen counter 421 has a cooker 423. In addition, a loudspeaker unit 400 is provided inside of a rectangular bending corner 424 of the L-shaped kitchen counter 421. The loudspeaker unit 400 has cylindrical (e.g., circular cylindrical) body 400*a*, in which the two-channel loudspeakers 31 and 32 are housed. The two-channel loudspeakers 31 and 32 are housed in the body 400*a* so as to be arranged one on top of the other along a virtual line segment X1 drawn in the upward/downward direction, and both emit a sound upward.

In the loudspeaker unit 400, the loudspeakers 31 and 32 are coaxially arranged in the upward/downward direction. That is to say, as in the first embodiment described above, an annular virtual sound image control area A10 is formed on a horizontal plane around the loudspeaker unit 400. Since the kitchen counter 421 is an L-shaped one in this example, an arc-shaped virtual sound image control area A101 connecting the sink 422 and the cooker 423 together is formed as a part of the virtual sound image control area A10.

In this example, two users H1 and H2 are present in the virtual sound image control area A101, one user H1 is facing the sink 422 in the virtual sound image control area A101, and the other user H2 is facing the cooker 423 in the virtual sound image control area A101. In this case, the sound images created are perceived by these two users H1 and H2 as virtually the same sound images.

The kitchen system 43 illustrated in FIG. 13B includes an I-shaped kitchen counter 431. A sink 432 is provided at one end of the I-shaped kitchen counter 431, and a cooker 433 is provided at the other end of the I-shaped kitchen counter 431. In addition, a loudspeaker unit 400 is provided in a central region of a front surface of the I-shaped kitchen counter 431.

Thus, as in the first embodiment described above, an annular virtual sound image control area A10 is formed on a horizontal plane around the loudspeaker unit 400. Since the kitchen counter 431 is an I-shaped one in this example, a semi-arc-shaped virtual sound image control area A102 connecting the sink 432 and the cooker 433 together is formed as a part of the virtual sound image control area A10.

In this example, two users H1 and H2 are present in the virtual sound image control area A102, one user H1 is facing the sink 432 in the virtual sound image control area A102, and the other user H2 is facing the cooker 433 in the virtual sound image control area A102. In this case, the sound images created are perceived, by these two users H1 and H2, as virtually the same sound images.

Figure 14:
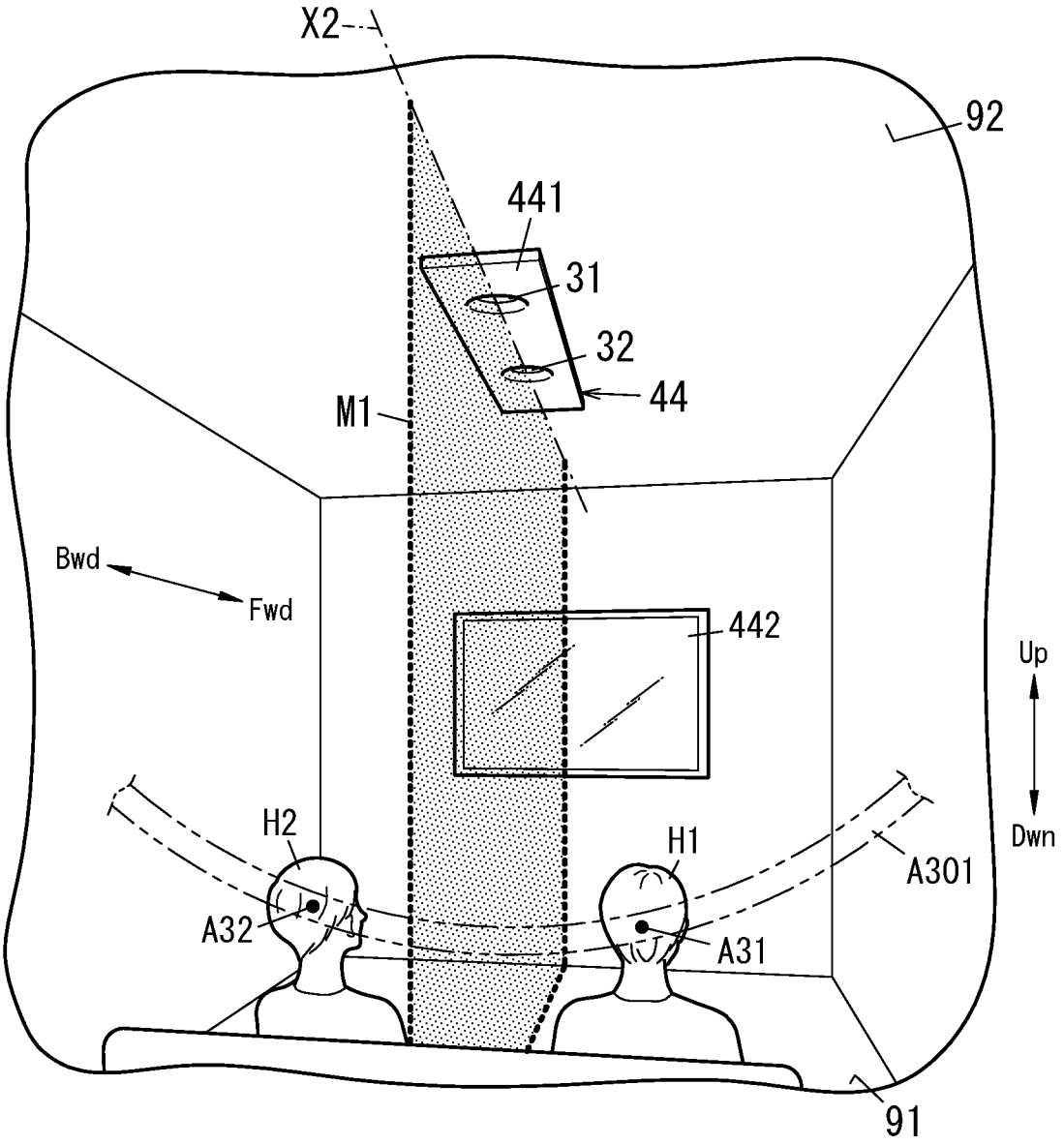
FIG. 14 is a perspective view illustrating a configuration for a ceiling member.

FIG. 14 illustrates, as a third exemplary application, a ceiling member 44. The ceiling member 44 includes a rectangular plate panel 441 to be mounted onto a ceiling surface 92 of a building such as a dwelling house, a bureau, a factory, an office, or a shop. On the lower surface of the panel 441, the two-channel loudspeakers 31 and 32 are mounted side by side in the forward/backward direction and emit respective sounds downward.

In the ceiling member 44, the two-channel loudspeakers 31 and 32 are arranged horizontally side by side, and the emission direction of each of the two-channel loudspeakers 31 and 32 is the downward direction and points to the same direction. That is to say, around the loudspeakers 31 and 32, an arc-shaped virtual sound image control area A301 is formed on a vertical plane as a part of the virtual sound image control area A30 according to the second embodiment described above. In this virtual sound image control area A301, a first listening area A31 and a second listening area A32 are formed symmetrically with respect to a virtual plane M1.

In this example, one user H1 is located in the first listening area A31, another user H2 is located in the second listening area A32, and both of these users H1 and H2 are watching a program displayed on a TV set 442 installed in front of them. In this case, these users H1 and H2 are listening to the audio accompanying the program on the TV set 442 and emitted from the loudspeakers 31 and 32, and the sound images created are perceived, by these users H1 and H2, as virtually the same sound images.

Optionally, a ceiling loudspeaker unit including the two-channel loudspeakers 31 and 32 may be mounted on the ceiling surface.

Figure 15:
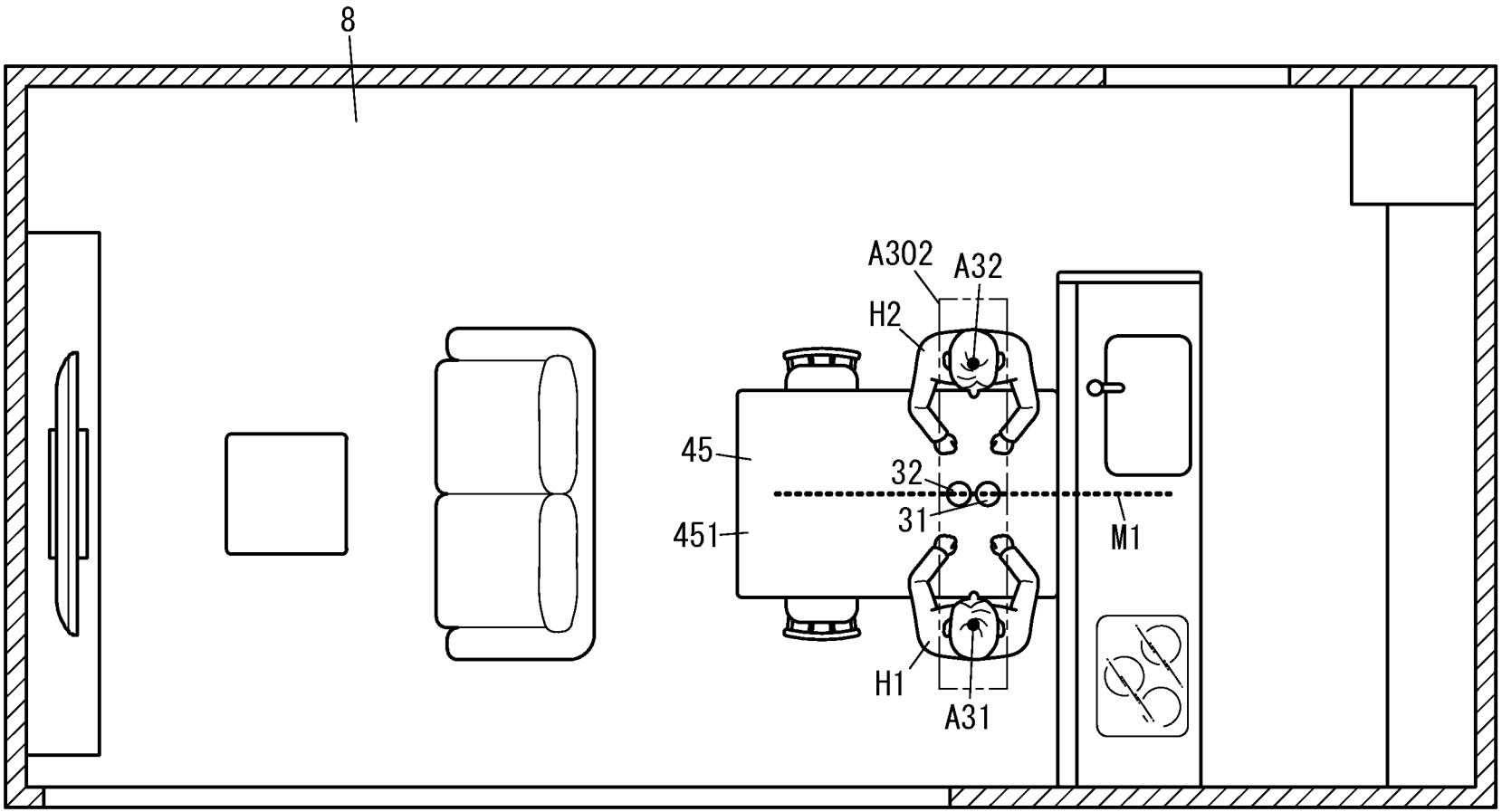
FIG. 15 is a top view illustrating a configuration for a table.

FIG. 15 illustrates, as a fourth exemplary application, a table (dining table) 45 installed in a living room 8 of a dwelling house. On the tabletop 451 of the table 45, the two-channel loudspeakers 31 and 32 are mounted and arranged side by side horizontally to emit respective sounds upward.

On the table 45, the two-channel loudspeakers 31 and 32 are arranged side by side horizontally and the emission direction of each of the two-channel loudspeakers 31 and 32 is the upward direction and points to the same direction. That is to say, around the loudspeakers 31 and 32, an arc-shaped virtual sound image control area A302 is formed on a vertical plane as a part of the virtual sound image control area A30 according to the second embodiment described above. In this case, the arc-shaped virtual sound image control area A302 is formed over the tabletop 451. In this virtual sound image control area A302, a first listening area A31 and a second listening area A32 are formed symmetrically with respect to the virtual plane M1.

In this example, one user H1 is located in the first listening area A31, another user H2 is located in the second listening area A32, and these two users H1 and H2 are facing each other in the forward/backward direction with the loudspeakers 31 and 32 interposed between them. In this case, the sound images created are perceived, by these two users H1 and H2, as virtually the same sound images.

Figure 16:
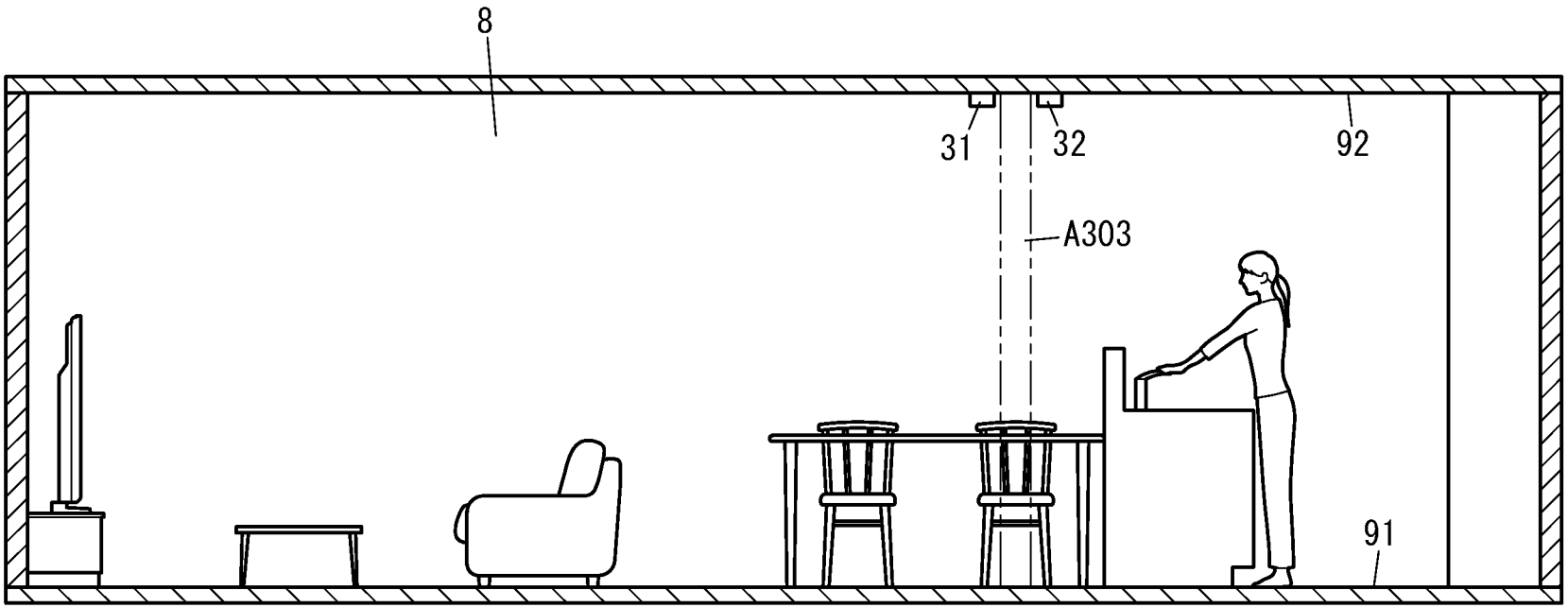
FIG. 16 is a side view illustrating an alternative arrangement of the two-channel loudspeakers.

Optionally, in the living room 8 of the dwelling house, the two-channel loudspeakers 31 and 32 may be mounted on the ceiling surface 92 and arranged side by side horizontally as shown in FIG. 16 so as to emit respective sounds downward. In that case, a semi-arc-shaped virtual sound image control area A303 is formed on a vertical plane under the ceiling surface 92 and a first listening area and a second listening area are defined within the virtual sound image control area A303.

Optionally, the two-channel loudspeakers 31 and 32 may be provided for any device other than the specific ones described for the exemplary embodiment, variations, and exemplary applications.

As can be seen from the foregoing description, a virtual sound image control system 1 according to a first aspect of the exemplary embodiment of the present invention includes two-channel loudspeakers 31 and 32 and a signal processor 2. The two-channel loudspeakers 31 and 32 each receive an acoustic signal and emit a sound. The signal processor 2 generates the acoustic signal and outputs the acoustic signal to the two-channel loudspeakers 31 and 32 so as to create a virtual sound image to be perceived by a user H as a stereophonic sound image. The two-channel loudspeakers 31 and 32 have the same emission direction. The two-channel loudspeakers 31 and 32 are arranged in line in the emission direction.

This virtual sound image control system 1, having such a simple configuration with two-channel loudspeakers 31 and 32, creates sound images to be perceived, by a plurality of users H in a virtual sound image control area A10, as virtually the same stereophonic sound images. In this case, the virtual sound image control area A10 defines listening areas for the users H.

In a virtual sound image control system 1 according to a second aspect of the exemplary embodiment, which may be implemented in conjunction with the first aspect, a virtual sound image control area A10 (i.e., listening areas for the users H) is suitably formed in the shape of an annular ring, of which the center is defined by the emission direction.

Thus, the virtual sound image control system 1 creates sound images to be perceived, by the plurality of users H present within the annular virtual sound image control area A10 (i.e., the listening areas for the users H), as virtually the same stereophonic sound images.

In a virtual sound image control system 1 according to a third aspect of the exemplary embodiment, which may be implemented in conjunction with the first or second aspect, the emission direction is suitably either a horizontal direction or an upward/downward direction.

Thus, the virtual sound image control system 1 creates sound images to be perceived, by the plurality of users H present within the annular virtual sound image control area A10 or an arc-shaped virtual sound image control area A101, A102 (i.e., the listening areas for the users H), as virtually the same stereophonic sound images.

A virtual sound image control system 1 according to a fourth aspect of the exemplary embodiment of the present invention includes two-channel loudspeakers 31 and 32 and a signal processor 2. The two-channel loudspeakers 31 and 32 each receive an acoustic signal and emit a sound. The signal processor 2 generates the acoustic signal and outputs the acoustic signal to the two-channel loudspeakers 31 and 32 so as to create a virtual sound image to be perceived by a user H as a stereophonic sound image. The two-channel loudspeakers 31 and 32 are arranged such that a first listening area A31 and a second listening area A32 for the user H are symmetric to each other with respect to a virtual plane M1 including a virtual line segment X2 connecting the two-channel loudspeakers 31 and 32 together.

This virtual sound image control system 1, having such a simple configuration with the two-channel loudspeakers 31 and 32, creates sound images to be perceived, by a plurality of users H present in the first listening area A31 and the second listening area A32, as virtually the same stereophonic sound images.

In a virtual sound image control system 1 according to a fifth aspect of the exemplary embodiment, which may be implemented in conjunction with the fourth aspect, the two-channel loudspeakers 31 and 32 are arranged one on top of the other in an upward/downward direction, and an emission direction of each of the two-channel loudspeakers 31 and 32 is suitably a horizontal direction and points to the same direction.

Thus, the virtual sound image control system 1 creates sound images to be perceived, by a plurality of users H who face the two-channel loudspeakers 31 and 32, as virtually the same stereophonic sound images.

In a virtual sound image control system 1 according to a sixth aspect of the exemplary embodiment, which may be implemented in conjunction with the fourth aspect, the two-channel loudspeakers 31 and 32 are arranged side by side horizontally. An emission direction of each of the two-channel loudspeakers 31 and 32 is suitably either an upward direction or a downward direction and points to the same direction.

Thus, the virtual sound image control system 1 creates sound images to be perceived, by the plurality of users H, as virtually the same stereophonic sound images through the two-channel loudspeakers 31 and 32 provided on a ceiling surface 92 or a table 45, for example.

In a virtual sound image control system 1 according to a seventh aspect of the exemplary embodiment, which may be implemented in conjunction with any one of the first to sixth aspects, the signal processor 2 suitably includes a signal processing unit 22 that generates the acoustic signal by convoluting a transfer function with respect to sound source data 211, 212. The transfer function is a compensation transfer function for reducing crosstalk in each of the sounds respectively emitted from the two-channel loudspeakers 31 and 32.

This allows the virtual sound image control system 1 to localize a sound image on the basis of each sound, corresponding to the sound source data 211, 212 and caught by the user H, both accurately and clearly.

In a virtual sound image control system 1 according to an eighth aspect of the exemplary embodiment, which may be implemented in conjunction with the seventh aspect, the signal processing unit 22 suitably further convolutes a head-related transfer function defined for the user H with respect to the sound source data.

This allows the virtual sound image control system 1 to localize a sound image on the basis of each sound, corresponding to the sound source data 211, 212 and caught by the user H, both accurately and clearly.

In a virtual sound image control system 1 according to a ninth aspect of the exemplary embodiment, which may be implemented in conjunction with the seventh or eighth aspect, the signal processing unit 22 suitably includes a sound source data storage unit 21 that stores the sound source data.

This allows the virtual sound image control system 1 to establish a transaural system by reading the sound source data from the sound source data storage unit 21.

A light fixture 41 according to a tenth aspect of the exemplary embodiment of the present invention includes: the two-channel loudspeakers 31 and 32 that form parts of the virtual sound image control system 1 according to any one of the first to ninth aspects; a light source 41*b*; and a light fixture body 410. The light fixture body 410 is equipped with the two-channel loudspeakers 31 and 32 and the light source 41*b*.

This light fixture 41, having such a simple configuration with two-channel loudspeakers 31 and 32, creates sound images to be perceived, by a plurality of users H, as virtually the same stereophonic sound images.

In a light fixture 41 according to an eleventh aspect of the exemplary embodiment of the present invention, which may be implemented in conjunction with the tenth aspect, the light fixture body 410 is suitably mounted onto a ceiling surface 92.

Such a light fixture 41 may be used as a pendant light fixture.

A kitchen system 42, 43 according to a twelfth aspect of the exemplary embodiment of the present invention includes the two-channel loudspeakers 31 and 32 that form parts of the virtual sound image control system 1 according to any one of the first to ninth aspects; and a kitchen counter 421, 431 equipped with the two-channel loudspeakers 31 and 32.

This kitchen system 42, 43, having such a simple configuration with two-channel loudspeakers 31 and 32, creates sound images to be perceived, by a plurality of users H, as virtually the same stereophonic sound images.

In a kitchen system 42 according to a thirteenth aspect of the exemplary embodiment of the present invention, which may be implemented in conjunction with the twelfth aspect, the kitchen counter is configured as an L-shaped kitchen counter 421, and the two-channel loudspeakers 31 and 32 are suitably arranged on an inner side of a bending corner 424 of the L-shaped kitchen counter 421.

This kitchen system 42, having such a configuration with the L-shaped kitchen counter 421, creates sound images to be perceived, by a plurality of users H, as virtually the same stereophonic sound images.

In a kitchen system 43 according to a fourteenth aspect of the exemplary embodiment of the present invention, which may be implemented in conjunction with the twelfth aspect, the kitchen counter is configured as an I-shaped kitchen counter 431, and the two-channel loudspeakers 31 and 32 are suitably arranged at a center of a front surface of the I-shaped kitchen counter 431.

A ceiling member 44 according to a fifteenth aspect of the exemplary embodiment of the present invention includes: the two-channel loudspeakers 31 and 32 that form parts of the virtual sound image control system 1 according to any one of the first to ninth aspects; and a panel 441 equipped with the two-channel loudspeakers 31 and 32.

This ceiling member 44, having such a simple configuration with the two-channel loudspeakers 31 and 32, creates sound images to be perceived, by a plurality of users H, as virtually the same stereophonic sound images.

A table 45 according to a sixteenth aspect of the exemplary embodiment of the present invention includes: the two-channel loudspeakers 31 and 32 that form parts of the virtual sound image control system 1 according to any one of the first to ninth aspects; and a tabletop 451 equipped with the two-channel loudspeakers 31 and 32.

This table 45, having such a simple configuration with the two-channel loudspeakers 31 and 32, creates sound images to be perceived, by a plurality of users H, as virtually the same stereophonic sound images.

Note that embodiments described above are only examples of the present disclosure and should not be construed as limiting. Rather, those embodiments may be readily modified in various manners, depending on a design choice or any other factor, without departing from a true spirit and scope of the present disclosure.

REFERENCE SIGNS LIST

1 Virtual Sound Image Control System
2 Signal Processor
21 Sound Source Data Storage Unit
211, 212 Sound Source Data
22 Signal Processing Unit
31, 32 Loudspeaker (Two-Channel Loudspeakers)
41 Light Fixture
41*b* Light Source
410 Light Fixture Body
42, 43 Kitchen System

421, 431 Kitchen Counter
424 Bending Corner
44 Ceiling Member
441 Panel
45 Table
451 Tabletop
92 Ceiling Surface
A10, A101, A102 Virtual Sound Image Control Area (Listening Area)
A31 First Listening Area
A32 Second Listening Area
H (H1, H2) User
M1 Virtual Plane
X2 Line Segment

The invention claimed is:

1. A virtual sound image control system comprising:

a two-channel loudspeaker system, including two loudspeakers, each of which is configured to receive an acoustic signal and emit a sound; and a signal processor configured to generate the acoustic signal and output the acoustic signal to the two-channel loudspeaker system so as to create a virtual sound image to be perceived by listeners as a stereophonic sound image, wherein:

the two loudspeakers are arranged such that a first listening area where a first listener to be present therein can perceive the virtual sound image and a second listening area where a second listener to be present therein can perceive the virtual sound image are symmetric to each other with respect to a virtual plane including a virtual line segment connecting the two loudspeakers together, and one of the two loudspeakers is arranged on top of another of the two loudspeakers in an upward/downward direction, and an emission direction of each of the two loudspeakers is a horizontal direction and points to the same direction.

2. A ceiling member comprising:

the virtual sound image control system according to claim 1; and a panel equipped with the two-channel loudspeaker system.

3. A table comprising:

the virtual sound image control system according to claim 2; and a tabletop equipped with the two-channel loudspeaker system.

4. The virtual sound image control system of claim 1, wherein:

the signal processor includes a signal processing unit configured to generate the acoustic signal by convoluting a transfer function with respect to sound source data, and the transfer function is a compensation transfer function for reducing crosstalk in each of the sounds respectively emitted from the two-channel loudspeaker system.

5. The virtual sound image control system of claim 4, wherein the signal processing unit is configured to further convolute a head-related transfer function defined for the listeners with respect to the sound source data.

6. The virtual sound image control system of claim 4, wherein the signal processing unit includes a sound source data storage unit configured to store the sound source data.

7. A virtual sound image control system comprising:

a two-channel loudspeaker system, including two loudspeakers, each of which is configured to receive an acoustic signal and emit a sound; and a signal processor configured to generate the acoustic signal and output the acoustic signal to the two-channel loudspeaker system so as to create a virtual sound image to be perceived by listeners as a stereophonic sound image, wherein:

the two loudspeakers are arranged such that a first listening area where a first listener to be present therein can perceive the virtual sound image and a second listening area where a second listener to be present therein can perceive the virtual sound image are symmetric to each other with respect to a virtual plane including a virtual line segment connecting the two loudspeakers together, the two loudspeakers are arranged side by side horizontally, and an emission direction of each of the two loudspeakers is either an upward direction or a downward direction and points to the same direction.

8. The virtual sound image control system of claim 7, wherein:

the signal processor includes a signal processing unit configured to generate the acoustic signal by convoluting a transfer function with respect to sound source data, and the transfer function is a compensation transfer function for reducing crosstalk in each of the sounds respectively emitted from the two-channel loudspeaker system.

9. The virtual sound image control system of claim 8, wherein the signal processing unit is configured to further convolute a head-related transfer function defined for the listeners with respect to the sound source data.

10. The virtual sound image control system of claim 8, wherein the signal processing unit includes a sound source data storage unit configured to store the sound source data.

11. A ceiling member comprising:

the virtual sound image control system according to claim 7; and a panel equipped with the two-channel loudspeaker system.

12. A table comprising:

the virtual sound image control system according to claim 7; and a tabletop equipped with the two-channel loudspeaker system.

13. A virtual sound image control system comprising:

a two-channel loudspeaker system, including two loudspeakers, each of which is configured to receive an acoustic signal and emit a sound; and a signal processor configured to generate the acoustic signal and output the acoustic signal to the two-channel loudspeaker system so as to create a virtual sound image to be perceived by listeners as a stereophonic sound image, wherein:

the two loudspeakers are arranged such that a first listening area where a first listener to be present therein can perceive the virtual sound image and a second listening area where a second listener to be present therein can perceive the virtual sound image are symmetric to each other with respect to a virtual plane including a virtual line segment connecting the two loudspeakers together, the signal processor includes a signal processing unit configured to generate the acoustic signal by convoluting a transfer function with respect to sound source data, and the transfer function is a compensation transfer function for reducing crosstalk in each of the sounds respectively emitted from the two-channel loudspeaker system.

14. The virtual sound image control system of claim 13, wherein the signal processing unit is configured to further convolute a head-related transfer function defined for the listeners with respect to the sound source data.

15. The virtual sound image control system of claim 13, wherein the signal processing unit includes a sound source data storage unit configured to store the sound source data.

16. A ceiling member comprising:

the virtual sound image control system according to claim 13; and a panel equipped with the two-channel loudspeaker system.

17. A table comprising:

the virtual sound image control system according to claim 13; and a tabletop equipped with the two-channel loudspeaker system.

* * * * *